US010449976B2

(12) United States Patent
Yamaguchi

(10) Patent No.: US 10,449,976 B2
(45) Date of Patent: Oct. 22, 2019

(54) PLUG DOOR OPENING-CLOSING DEVICE

(71) Applicant: NABTESCO CORPORATION, Tokyo (JP)

(72) Inventor: Atsuhito Yamaguchi, Kobe (JP)

(73) Assignee: NABTESCO CORPORATION, Tokyo (JP)

( * ) Notice: Subject to any disclaimer, the term of this patent is extended or adjusted under 35 U.S.C. 154(b) by 422 days.

(21) Appl. No.: 14/857,432

(22) Filed: Sep. 17, 2015

(65) Prior Publication Data

US 2016/0083982 A1 Mar. 24, 2016

(30) Foreign Application Priority Data

Sep. 22, 2014 (JP) ..... 2014-192214

(51) Int. Cl.
*B61D 19/00* (2006.01)
*E05B 79/10* (2014.01)
(Continued)

(52) U.S. Cl.
CPC ..... *B61D 19/008* (2013.01); *E05B 79/10* (2013.01); *E05B 81/02* (2013.01); *E05B 83/40* (2013.01);
(Continued)

(58) Field of Classification Search
CPC ... B61D 19/008; B61D 19/009; E05F 15/638; E05F 15/649; E05F 15/655; E05B 83/363; E05B 83/40; E05B 65/08
See application file for complete search history.

(56) References Cited

U.S. PATENT DOCUMENTS 5,483,769 A * 1/1996 Zweili ..... B61D 19/008 49/118
9,316,030 B2 * 4/2016 Takahashi ..... B61D 19/009
(Continued)

FOREIGN PATENT DOCUMENTS

CN 102187042 A 9/2011
CN 103415668 A 11/2013
(Continued)

OTHER PUBLICATIONS

Notification of First Office Action Chinese Patent Application No. 201510603466.5 dated May 22, 2017 with English translation.
(Continued)

*Primary Examiner* — Gregory J Strimbu
(74) *Attorney, Agent, or Firm* — Pillsbury Winthrop Shaw Pittman, LLP

(57) ABSTRACT

A plug door opening-closing apparatus includes a lock mechanism, a drive mechanism, and a door support mechanism. The lock mechanism is directly or indirectly arranged on one of the upper and lower portions of at least one door of a vehicle. The lock mechanism locks the door when completely closed so that the door does not open. The drive mechanism is coupled to the lock mechanism and drives the lock mechanism to switch the door from an unlocked state to a locked state. The door support mechanism is mechanically coupled to the lock mechanism and supports the door. When the completely closed door is switched from the unlocked state to the locked state, the door support mechanism is adapted to hold the door and hinder outward displacement, in a vehicle width direction, of the other portion of the door where the lock mechanism is not arranged.

22 Claims, 20 Drawing Sheets

(51) Int. Cl.

| | |
|---|---|
| ***E05B 81/02*** | (2014.01) |
| ***E05B 83/40*** | (2014.01) |
| ***E05B 85/24*** | (2014.01) |
| ***E05C 1/08*** | (2006.01) |
| ***E05C 7/04*** | (2006.01) |
| ***E05F 15/638*** | (2015.01) |

(52) U.S. Cl.
CPC ..... *E05B 85/243* (2013.01); *E05C 1/08* (2013.01); *E05C 7/045* (2013.01); *E05F 15/638* (2015.01); *E05Y 2900/51* (2013.01)

(56) References Cited

U.S. PATENT DOCUMENTS

| | | | | |
|---|---|---|---|---|
| 2010/0276945 | A1* | 11/2010 | Pritz | E05B 83/363 292/57 |
| 2014/0020299 | A1 | 1/2014 | Takahashi et al. | |
| 2014/0366449 | A1* | 12/2014 | Masuda | B61D 19/007 49/281 |
| 2015/0054294 | A1 | 2/2015 | Uno et al. | |
| 2015/0145264 | A1 | 5/2015 | Takahashi et al. | |
| 2015/0184433 | A1* | 7/2015 | Ueda | E05B 85/20 292/201 |
| 2016/0123047 | A1* | 5/2016 | Ueda | E05B 81/21 292/194 |
| 2016/0215543 | A1* | 7/2016 | Mair | E05D 15/1068 |
| 2016/0305169 | A1 | 10/2016 | Takahashi et al. | |

FOREIGN PATENT DOCUMENTS

| | | | |
|---|---|---|---|
| CN | 103781982 | A | 5/2014 |
| EP | 1 568 563 | A1 | 8/2005 |
| EP | 1 724 138 | A2 | 11/2006 |
| EP | 2348181 | A1 | 7/2011 |
| EP | 2685036 | A1 | 1/2014 |
| JP | 2008-121244 | A | 5/2008 |
| WO | WO 2012/121268 | * | 9/2012 |

OTHER PUBLICATIONS

Office Action as issued in United Kingdom patent application No. GB1516466.8, dated Mar. 17, 2016.
Office Action and Search Report issued in corresponding French Application No. 1558719 dated Oct. 16, 2018.

* cited by examiner

PLUG DOOR OPENING-CLOSING DEVICE

CROSS-REFERENCE TO RELATED APPLICATIONS

This application is based upon and claims the benefit of priority from prior Japanese Patent Application No. 2014-192214, filed on Sep. 22, 2014, the entire contents of which are incorporated herein by reference.

FIELD

The present invention relates to a plug door opening-closing device/apparatus that moves a door panel in a vehicle front-rear direction and a vehicle width direction and a plug door device that includes the plug door opening-closing apparatus.

BACKGROUND

Japanese Laid-Open Patent Publication No. 2008-121244 describes an example of a conventional sliding plug door device for a railway vehicle. The plug door device includes a plug door opening-closing apparatus that performs an operation for moving doors in the width direction of a railway vehicle when sliding the door in the front-rear direction of the railway vehicle, that is, the so-called plugging operation. The plug door device includes a lock mechanism that restricts movement of the doors in the vehicle front-rear direction and the width direction when the doors are completely closed and completely cover an entrance located in a vehicle side wall.

SUMMARY

The lock mechanism is configured to restrict movement of door hangers coupled to upper end portions of the doors. For example, when lower end portions of the doors receive large force that presses the doors outward in the vehicle width direction, the lower end portions of the doors are displaced outward in the vehicle width direction. This may form a gap between the lower end portions of the doors and the entrance.

If the rigidity of the doors and the lock mechanism is increased so that such displacement and a gap are avoided, the doors and the lock mechanism become heavier. This may hinder the assembling of a door device.

It is an object of the present invention to provide a plug door opening-closing apparatus and a plug door device that limit displacement of a door in the vehicle width direction when receiving excessive external force without the need for increases in the rigidity of the door and a lock mechanism.

One aspect of the present invention is a plug door opening-closing apparatus that includes a lock mechanism, a drive mechanism, and a door support mechanism. The lock mechanism is directly or indirectly arranged on one of an upper portion and a lower portion of at least one door of a vehicle. The lock mechanism locks the door when the door is completely closed so that the door does not open. The drive mechanism is coupled to the lock mechanism. The drive mechanism drives the lock mechanism to switch the door from an unlocked state to a locked state. The door support mechanism is mechanically coupled to the lock mechanism and supports the door. When the completely closed door is switched from the unlocked state to the locked state, the door support mechanism is adapted to hold the door and hinder outward displacement, in a vehicle width direction, of the other one of the upper portion and the lower portion of the door that is less the lock mechanism.

In the above structure, even when a door receives large force that presses the door outward in the vehicle width direction, the door support mechanism hinders outward displacement, in the vehicle width direction, of the upper portion and the lower portion of the door. This limits the formation of a gap between a vehicle side wall of the vehicle and the door. The rigidity of the door and the lock mechanism does not necessarily have to be improved.

In some implementations, the plug door opening-closing apparatus further includes at least one swing arm mechanism that guides movement of the door in the vehicle width direction. The door support mechanism holds the door by restricting movement of the swing arm mechanism.

In the above structure, the door support mechanism restricts movement of the swing arm mechanism arranged on the edge of the vehicle side wall, which is adjacent to an opening of the vehicle. Thus, the door support mechanism may be arranged on the vehicle side wall, which is adjacent to the opening. This widens the opening of the vehicle side wall.

In some implementations of the plug door opening-closing apparatus, the door support mechanism includes a restriction member that limits movement of a movable portion of the swing arm mechanism to restrict movement of the swing arm mechanism. In cooperation with the switching of the lock mechanism, the restriction member is movable to a restriction position, where the restriction member restricts movement of the swing arm mechanism, and a non-restriction position, where the restriction member does not restrict movement of the swing arm mechanism.

In some implementations of the plug door opening-closing apparatus, the restriction member contacts the movable portion at the restriction position.

The above structure further limits the formation of a gap between the vehicle side body and the door compared to when a gap is formed between the restriction member and the movable portion when the restriction member is located at the restriction position.

In some implementations of the plug door opening-closing apparatus, the drive mechanism is directly or indirectly arranged on the upper portion of the door. The movable portion defines an upper portion of the swing arm mechanism.

The above structure allows the drive mechanism and the restriction member to be located close to each other compared to a structure in which the restriction member contacts a lower portion of the swing arm mechanism to restrict movement of the swing arm mechanism. Thus, the drive force of the drive mechanism may be easily transmitted to the restriction member.

In some implementations of the plug door opening-closing apparatus, the door support mechanism further includes a movable bracket and a coupling rod. The movable bracket is coupled to one of the lock mechanism and the drive mechanism and moves in a vehicle front-rear direction. The coupling rod extends in the vehicle front-rear direction and couples the movable bracket and the restriction member.

The above structure stabilizes the operation of the door support mechanism compared to a structure in which the drive force is transmitted to the restriction member from the lock mechanism or the drive mechanism, for example, using wires.

In some implementations of the plug door opening-closing apparatus, the coupling rod includes a length adjustment mechanism.

In the above structure, the position of the restriction member may be adjusted relative to the movable portion of the swing arm mechanism in the vehicle front-rear direction by adjusting the length of the coupling rod. Thus, even after the plug door opening-closing apparatus is assembled, the position of the restriction member may be easily changed so that the displacement in the width direction X is further appropriately limited in the upper or lower end portion of the door.

In some implementations of the plug door opening-closing apparatus, the door support mechanism further includes at least one support member fixed to the vehicle. The support member is adapted to support the coupling rod and hinder outward deformation, in the vehicle width direction, of the coupling rod.

Movement of the swing arm mechanism may apply large force pressing the coupling rod outward in the vehicle width direction. This would deform the coupling rod, and such deformation causes the restriction member to be displaced relative to the swing arm mechanism. In this regard, in the above structure, the support member hinders displacement of the restriction member by limiting deformation of the coupling rod. Thus, the restriction member appropriately maintains the function to restrict movement of the movable portion of the swing arm mechanism.

In some implementations of the plug door opening-closing apparatus, the at least one support member includes a plurality of support members that support the coupling rod at different positions in the vehicle front-rear direction. The restriction member is located between two adjacent ones of the support members.

In the above structure, the opposite ends of the restriction member, which receives force from the swing arm mechanism, are supported in the vehicle front-rear direction. This further limits deformation of the coupling rod in the vehicle width direction.

In some implementations of the plug door opening-closing apparatus, the door support mechanism further includes a guide member that guides movement of the movable bracket in the vehicle front-rear direction.

In the above structure, when force is applied to the door, the force is received by the guide member. This hinders the force, which is applied to the door, from being transmitted to the lock mechanism. Thus, the lock mechanism is stably maintained in the locked state. Additionally, the movable bracket smoothly moves in the front-rear direction due to the guide member. Thus, the lock mechanism may be smoothly switched to the locked state and the unlocked state. In particular, the load may be reduced when an operator manually switches the state.

In some implementations of the plug door opening-closing apparatus, the at least one door includes two doors, and the at least one swing arm mechanism includes two swing arm mechanisms, which respectively correspond to the two doors. The door support mechanism includes two of the restriction members that respectively correspond to the two swing arm mechanisms and two of the coupling rods that respectively correspond to the two swing arm mechanisms.

In the above structure, the two restriction members may be simultaneously moved by moving the coupling rod. This simplifies the task for manually opening and closing the door compared to when an operator individually moves the restriction members.

In some implementations of the plug door opening-closing apparatus, the swing arm mechanism includes an upper swing arm rotated outward in the vehicle width direction about a rotational axis extending in a height direction when receiving force that moves the door outward in the vehicle width direction. The movable portion includes the upper swing arm.

In some implementations of the plug door opening-closing apparatus, the swing arm mechanism further includes a lower swing arm and a pillar. The lower swing arm supports the lower portion of the door and guides movement of the door when rotated outward in the vehicle width direction about a rotational axis extending in the height direction. The pillar couples the upper swing arm and the lower swing arm.

In the above structure, the force necessary to restrict movement of the swing arm mechanism is decreased compared to when the door support mechanism directly applies force to the pillar. This eliminates the need for increasing the rigidity of the door support mechanism. Thus, the door support mechanism may be reduced in size. Additionally, rotation of the lower swing arms is restricted in addition to rotation of the upper swing arms. This hinders the formation of a gap between the lower end portion of the door and the vehicle side wall.

In some implementations, the plug door opening-closing apparatus further includes a pressed portion coupled to the door. When the lock mechanism locks the door, the pressed portion comes into contact with the lower swing arm and is pressed toward a door closing side.

In the above structure, when the lock mechanism is in the locked state, displacement toward the opposite side in the vehicle front-rear direction, that is, the door opening side, is limited in the lower portion of the door.

In some implementations of the plug door opening-closing apparatus, the pressed portion includes a contact surface that contacts the lower swing arm, and the contact surface is inclined relative to the vehicle front-rear direction. The plug door opening-closing apparatus further includes a roller coupled to the lower swing arm and a lower sliding rail coupled to the lower portion of the door and extending in the vehicle front-rear direction. The lower swing arm supports the lower sliding rail via the roller that contacts with the lower sliding rail from at least an inner side in the vehicle width direction.

In the above structure, when the door moves in the vehicle front-rear direction, the lower sliding rail smoothly moves relative to the lower swing arm. Additionally, when the door is closed, the lower swing arm receives an outward component, in the vehicle width direction, of the force acting on the pressed portion. Thus, outward displacement in the vehicle width direction is limited in the door.

In some implementations of the plug door opening-closing apparatus, the swing arm mechanism further includes a restricted rod that is coupled to the upper swing arm and extends in the height direction. The restriction member restricts rotation of the upper swing arm by limiting movement of the restricted rod at the restriction position.

In the above structure, the position in which the restriction member contacts the restricted rod may be selected from a range of the length of the restricted rod. This increases the degree of freedom for designing the position in which the restriction member is located in the height direction.

In some implementations of the plug door opening-closing apparatus, the swing arm mechanism further includes a rod wheel rotatably coupled to the restricted rod. The restriction member restricts movement of the restricted rod when contacting the rod wheel.

In the above structure, when the restriction member moves in the vehicle front-rear direction, the rod wheel comes in contact with the restriction member and rotates. This decreases friction force between the restriction member and the rod wheel. Thus, the restriction member smoothly comes in contact with and separates from the restricted rod.

In some implementations, the plug door opening-closing apparatus further includes a guide arm that moves the door in the vehicle width direction when rotated about a rotational axis extending in the height direction. The restricted rod is coupled to the guide arm.

In the above structure, the restricted rod is coupled to the upper swing arm and the guide arm. This limits deformation of the restricted rod. Thus, movement of the movable portion of the swing arm mechanism is stably restricted.

In some implementations, the plug door opening-closing apparatus further includes an auxiliary arm coupled to the upper swing arm to be rotatable about a rotational axis extending in the height direction. The auxiliary arm adjusts a position of the upper swing arm relative to the guide arm. The restricted rod, which is coupled to the auxiliary arm, indirectly couples the restricted rod to the upper swing arm.

In the above structure, even when errors in the rotational positions of the upper swing arm and the guide arm occur, such errors may be offset by rotating the auxiliary arm relative to the upper swing arm during the assembling of the swing arm mechanism.

In some implementations of the plug door opening-closing apparatus, the auxiliary arm includes a length adjustment mechanism.

In the above structure, the position of the movable portion of the swing arm mechanism may be adjusted relative to the restriction member by adjusting the length of the auxiliary arm. Thus, even after the plug door opening-closing apparatus is assembled, the position of the movable portion of the swing arm mechanism may be easily changed so that the displacement in the width direction is further appropriately limited in a further portion of the door.

In some implementations of the plug door opening-closing apparatus, the restriction member includes a flat surface that extends in the vehicle front-rear direction, and the flat surface contacts the movable portion.

In the above structure, even when force that presses the restriction member outward in the vehicle width direction is applied from the movable portion of the swing arm mechanism to the restriction member, the formation of a component of the force, which acts in the vehicle front-rear direction, is limited. This decreases situations in which the restriction member is moved to the non-restriction position due to the force applied to the door or the like in the locked state.

In some implementations of the plug door opening-closing apparatus, the restriction member includes an inclined surface at a portion through which the movable portion passes when moving from the non-restriction position to the restriction position. The inclined surface is continuous with the flat surface and inclined outward in the vehicle width direction from the flat surface.

In the above structure, when the restriction member moves from the non-restriction position to the restriction position, the inclined surface of the restriction member comes in contact with the movable portion. Thus, the movable portion is moved along the inclined surface and guided to the flat surface of the restriction member. This smoothly moves the movable portion to the flat surface.

In some implementations of the plug door opening-closing apparatus, the drive mechanism also functions as a drive source that opens and closes the door.

The drive force of the drive mechanism for moving the door is larger than the drive force that is output from a drive source dedicated to a lock mechanism. Such a large drive force is used to drive the door support mechanism. Thus, outward displacement in the vehicle width direction is further assuredly limited in the upper end portion or the lower end portion of the door. Additionally, the number of the drive sources in the plug door opening-closing apparatus may be reduced compared to when the drive source dedicated to the lock mechanism is provided.

Another aspect of the present invention is a plug door device that includes a vehicle door and one of the above the plug door opening-closing apparatus that opens and closes the door.

In some aspects of the present invention, even when the door receives large force that presses the door outward in the vehicle width direction, displacement of the door may be decreased in the vehicle width direction without increases in the rigidity of the door and the lock mechanism.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

Figure 1:
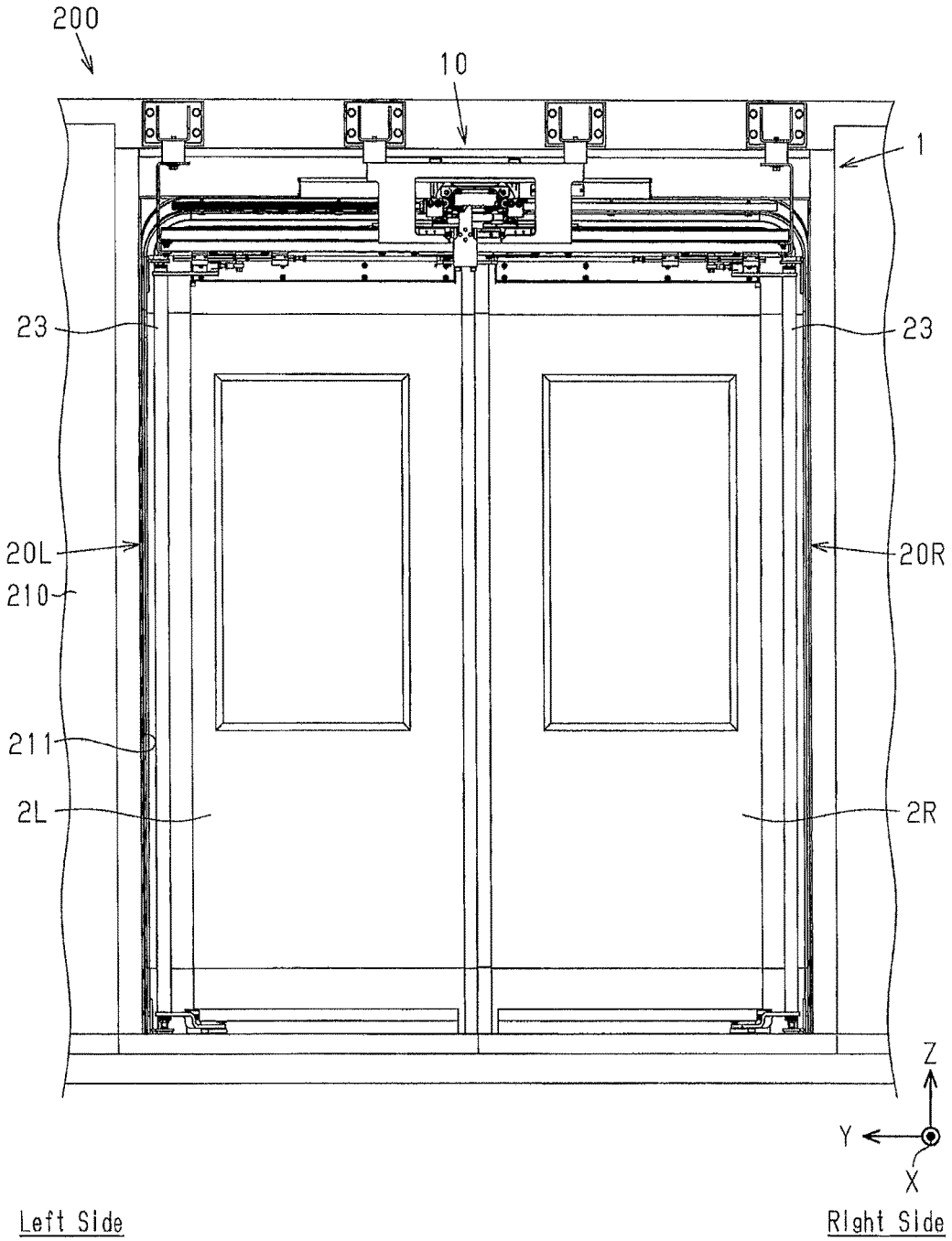
FIG. 1 is a front view showing one embodiment of a plug door device.

With reference to FIG. 1, a plug door device 1 for a vehicle 200, which may be a railway vehicle, will now be described. In the description, hereafter, axes X, Y, Z in the orthogonal coordinate system of FIG. 1 refer to a vehicle width direction X, a vehicle front-rear direction Y, and a vehicle height direction Z, respectively.

The width direction X may refer to a plugging motion direction and an unplugging motion direction of doors 2R, 2L. In some examples, the width direction X refers to a direction that is intersected with or orthogonal to an outer or inner surface of each of the doors 2R, 2L. The front-rear direction Y may refer to a sliding motion direction of the doors 2L, 2R. The front-rear direction Y may refer to a sliding motion direction of the doors 2R, 2L. In some examples, the front-rear direction Y refers to a horizontal direction that is substantially parallel to the outer or inner surface of each of the doors 2R, 2L.

In the present specification, the terms "right side" and "left side" respectively correspond to the right side and the left side when the plug door device 1 is viewed from the inside of the vehicle 200 and are set as shown in FIG. 1. In the present specification, reference characters ending with a letter "L" or "R" may be given to those components of the plug door device 1 that are paired at the left and right sides.

FIGS. 1 to 6, 8, 10 and 11 each show a completely closed state in which the doors 2L, 2R completely covers an opening provided for a vehicle side wall 210 of the vehicle 200, or an entrance 211.

The plug door device 1 includes the double sliding doors 2L, 2R, which open and close the entrance 211, and a plug door opening-closing apparatus 10, which drives or moves the doors 2L, 2R in the width direction X and the front-rear direction Y. The plug door device 1 includes two swing arm mechanisms 20L, 20R that guide movement of the doors 2L, 2R in the width direction X and the front-rear direction Y. In some examples, the doors 2L, 2R are flush with the outer surface of the vehicle side wall 210 when completely closed.

Figure 2:
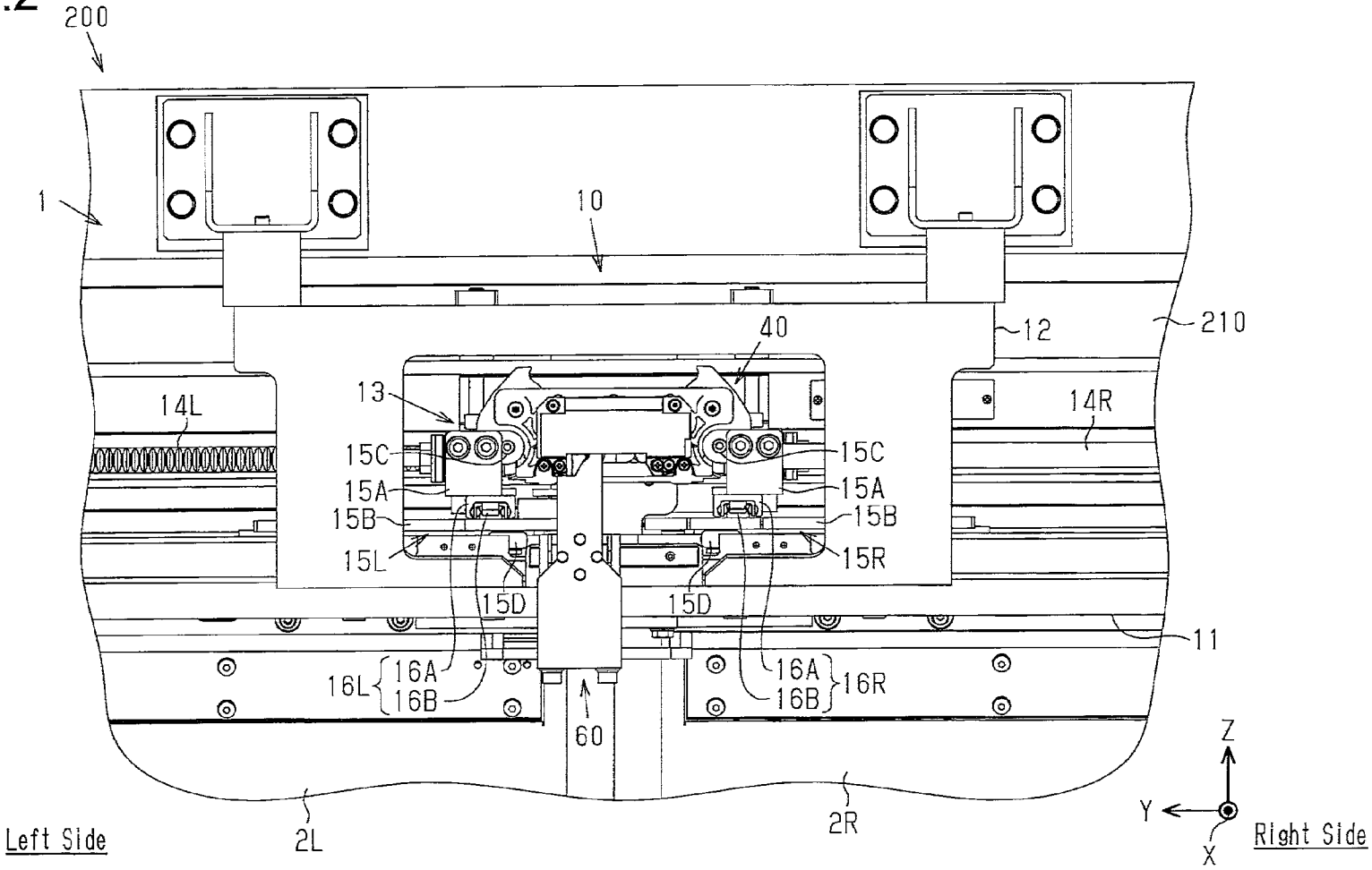
FIG. 2 is an enlarged view showing a plug door opening-closing apparatus of FIG. 1.

As shown in FIG. 2, the plug door opening-closing apparatus 10 is located at an upper side of the entrance 211 and includes a base extending in the front-rear direction Y. The base 11 is supported by a support frame 12, which is located in a position corresponding to an upper end portion of the doors 2L, 2R and a middle portion of the base 11 in the front-rear direction Y. The support frame 12 is fixed to the vehicle side wall 210.

A drive mechanism 13 and a lock mechanism 40 are located on the base 11. The drive mechanism 13 moves, the doors 2L, 2R in the width direction X and the front-rear direction Y. The lock mechanism 40 locks the doors 2L, 2R so that the doors 2L, 2R do not open when completely closed. The drive mechanism 13 drives the lock mechanism 40 so that the doors 2L, 2R are switched from an unlocked state to a locked state. Alternatively, the drive mechanism 13 may drive the lock mechanism 40 so that the doors 2L, 2R are switched from the locked state to the unlocked state.

The drive mechanism 13 includes a motor (not shown), which is located in the support frame 12, and a planetary gear mechanism (not shown), which is connected to an output shaft of the motor. The output shaft of the motor and each gear in the planetary gear mechanism rotate about a rotational axis extending in the height direction Z.

Although not shown in the drawings, the planetary gear mechanism may include a pinion gear, which functions as a first output portion, and a carrier, which functions as a second output portion. The pinion gear is engaged with two rack gears 14L, 14R. The rack gears 14L, 14R are located at the same height and separated in the width direction X. The rack gear 14L extends to the left from the middle of the plug door opening-closing apparatus 10 in the front-rear direction Y. The rack gear 14R, which is located at an inner side of the rack gear 14L in the width direction X, extends to the right from the middle of the plug door opening-closing apparatus 10 in the front-rear direction Y. The drive mechanism 13 may have the same structure as the rack and pinion mechanism, the planetary gear mechanism, the motor, and the switch mechanism for switching an output of the planetary gear mechanism that are described in Japanese Laid-Open Patent Publication No. 2008-121244. In Japanese Laid-Open Patent Publication No. 2008-121244, the motor and the gears and the carrier in the planetary gear mechanism are configured to rotate about rotational axes extending in the width direction X. In contrast, in the embodiment, the motor and the gears and the carrier in the planetary gear mechanism of the drive mechanism 13 rotate about rotational axes extending in the height direction Z.

A door hanger 15L, which is fixed to the door 2L, is fixed to a left end of the rack gear 14R. In the same manner, a door hanger 15R is fixed to a right end of the rack gear 14L. Each of the door hangers 15L, 15R moves in the width direction X and the front-rear direction Y along the corresponding one of two inclined rails, which are included in the base 11.

The door hangers 15L, 15R each include a first coupling plate 15A, which is coupled to the corresponding one of the rack gears 14L, 14R, and a second coupling plate 15B, which extends in the width direction X and is coupled to the corresponding one of the doors 2L, 2R. Each first coupling plate 15A is L-shaped and includes an inner end, in the width direction X, extending in the height direction Z. A shaft 15C extending in the width direction X is coupled to the inner end of each first coupling plate 15A in the width direction X.

A roller 15D, which moves along the corresponding inclined rail, is coupled to the lower surface of each second coupling plate 15B. Hanger guide mechanisms 16L, 16R, which guide movement of the corresponding door hangers 15L, 15R in the width direction X, are each coupled to the upper surface of the corresponding second coupling plate 15B. The hanger guide mechanisms 16L, 16R each include a rail 16A, which is fixed to the corresponding first coupling plate 15A, and a slider 16B, which is fixed to the corresponding second coupling plate 15B. Each rail 16A extends in the width direction X. Each slider 16B is engaged with the corresponding rail 16A and movable in the width direction X along the rail 16A. This structure allows each second coupling plate 15B to move relative to the corresponding first coupling plate 15A in the width direction X and integrally with the first coupling plate 15A in the front-rear direction Y. Each shaft 15C moves integrally with the corresponding first coupling plate 15A.

Figure 3:
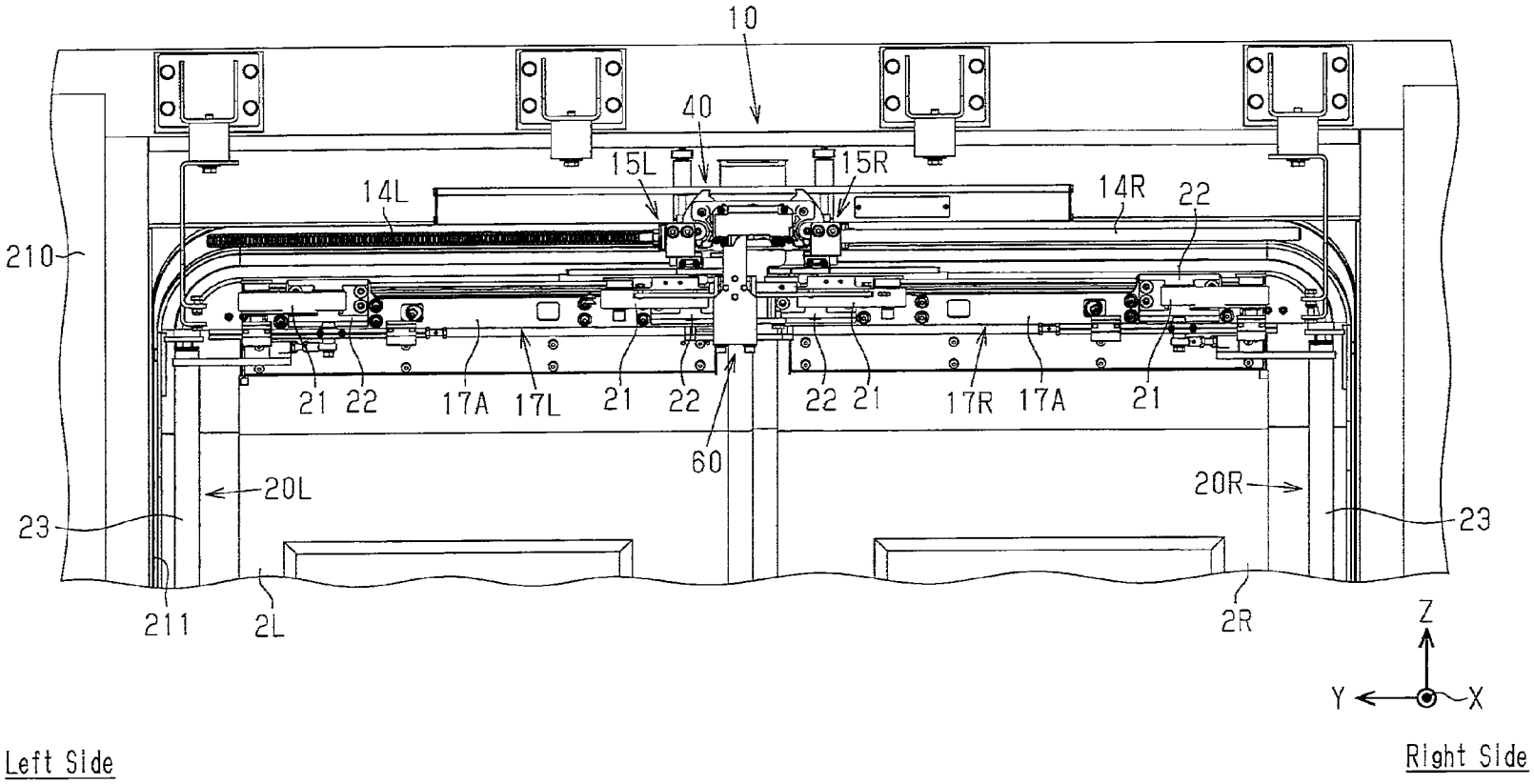
FIG. 3 is an enlarged view showing an upper portion of the plug door device of FIG. 1.

As shown in FIG. 3, which does not show the base 11 and the support frame 12, the swing arm mechanisms 20L, 20R are located on edges of the vehicle side wall 210 that are adjacent to the entrance 211 in the front-rear direction Y, that is, the front edge and the rear edge of the entrance 211. The swing arm mechanisms 20L, 20R each include two guide arms 21 (refer to FIG. 3), which support the upper end portion of the corresponding one of the doors 2L, 2R. The two guide arms 21 of each swing arm mechanism are located on two opposite ends, in the front-rear direction Y, of the corresponding one of the doors 2L, 2R and fixed to the base 11. The two guide arms 21, which are associated with each door, may be referred to as the opening-side guide arm and the closing-side guide arm.

The distal end of each guide arm 21 is coupled to an arm coupling member 22, which is coupled to the corresponding one of two arm guide mechanisms 17L, 17R. The arm guide mechanisms 17L, 17R are each coupled to the upper end portion of the corresponding one of the doors 2L, 2R. The arm guide mechanisms 17L, 17R each include a guide rail (not shown), which is coupled to the corresponding one of the doors 2L, 2R, and a support body 17A, which is movable relative to the guide rail in the front-rear direction Y. Each arm coupling member 22 is coupled to the corresponding support body 17A. When the doors 2L, 2R move in the front-rear direction Y, the guide rails of the doors 2L, 2R move in the front-rear direction Y relative to the support bodies 17A of the arm guide mechanisms 17L, 17R. Thus, the guide arms 21 and the arm coupling members 22 support the doors 2L, 2R in the width direction X.

Figure 4:
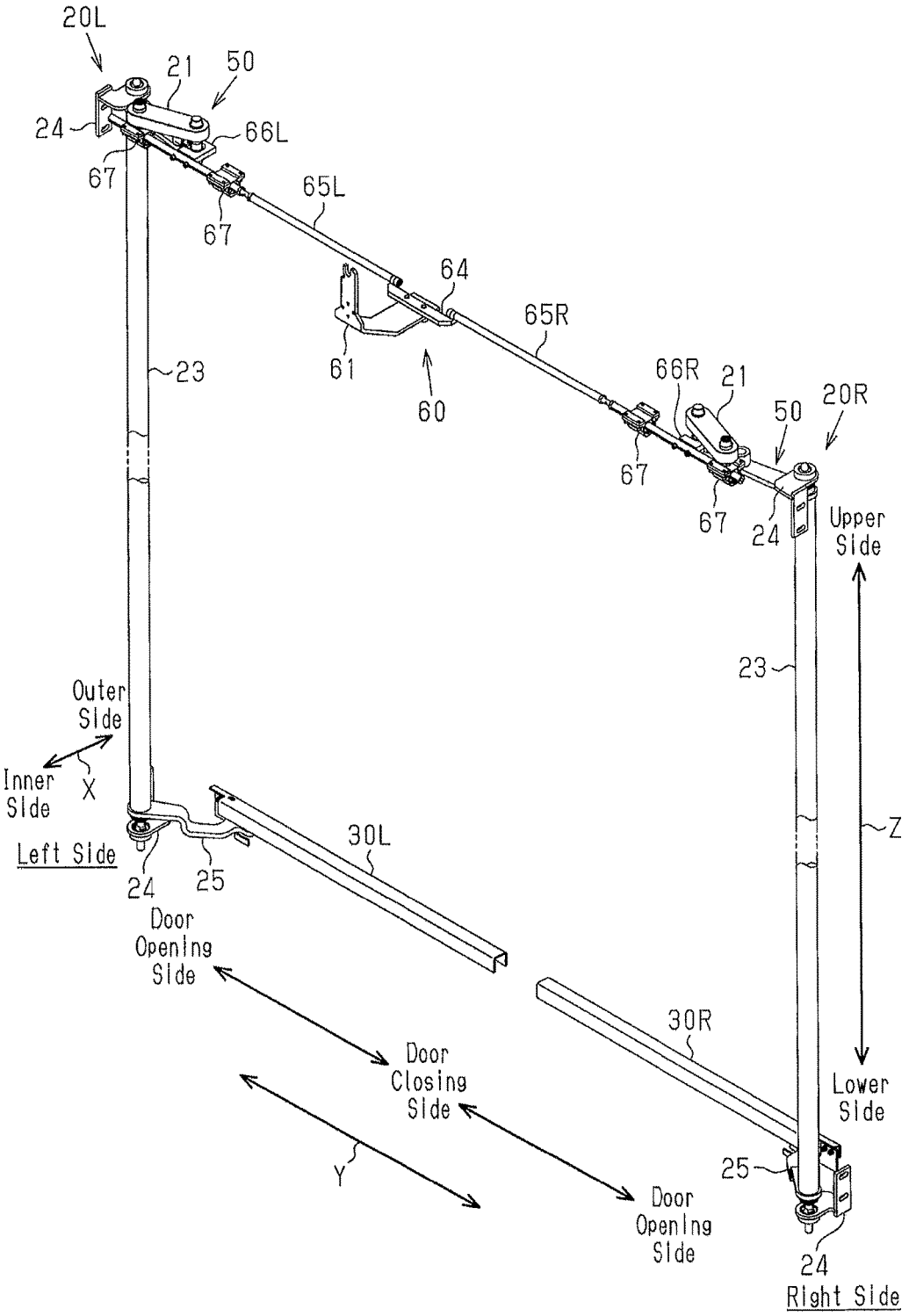
FIG. 4 is a perspective view showing a swing arm mechanism and a door support mechanism.

As shown in FIG. 4, the swing arm mechanisms 20L, 20R each include a pillar 23, which extends in the height direction Z. Each pillar 23 is located at the door opening side of the corresponding door opening-side guide arm 21. The upper and lower end portions of each pillar 23 are rotatably coupled to upper and lower brackets 24, respectively, which are fixed to the vehicle side wall 210 (refer to FIG. 3). A lower swing arm 25 is coupled to a portion of each pillar 23 that is located above and adjacent to the corresponding lower bracket 24 in a non-rotatable manner. Each lower swing arm 25 supports a lower end portion of the corresponding one of the doors 2L, 2R (refer to FIG. 2). The distal end of each lower swing arm 25, which is connected and fixed to the lower end portion of the corresponding one of the doors 2L, 2R, supports the corresponding one of lower sliding rails 30L, 30R, which extend in the front-rear direction Y. A coupling mechanism 50, which is coupled to the upper end portion of each pillar 23, rotates the pillar 23 in accordance with rotation of the corresponding guide arm 21. The coupling mechanism 50 couples the pillar 23 and the door opening-side guide arm 21.

Figure 5:
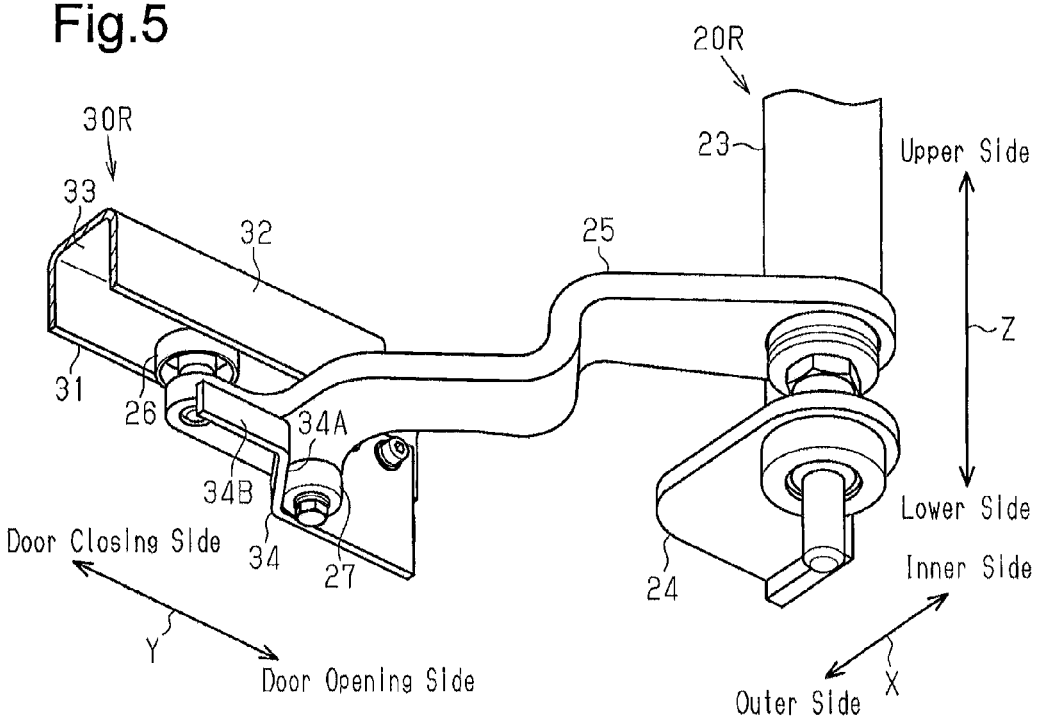
FIG. 5 is a perspective view showing a lower swing arm of the swing arm mechanism of FIG. 4.
Figure 6:
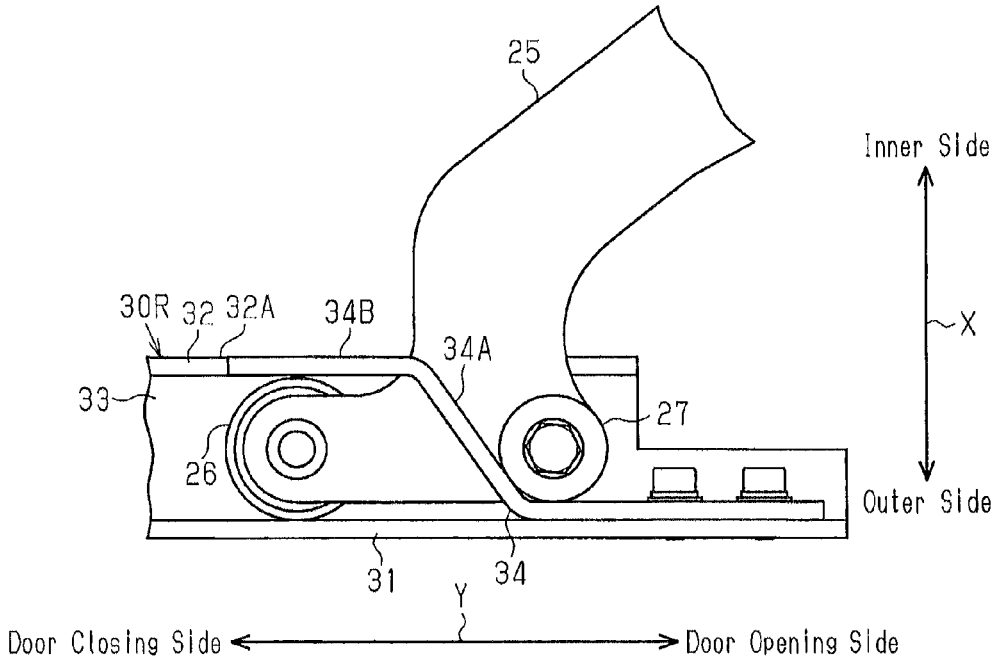
FIG. 6 is an enlarged view showing a distal portion of the lower swing arm of FIG. 5.

As shown in FIG. 5, the lower sliding rail 30R is U-shaped and opens downward to form a groove. The lower sliding rail 30R includes an outer wall 31, which is fixed to the door 2R (refer to FIG. 3), an inner wall 32, which is separated inward in the width direction X from the outer wall 31, and upper wall 33, which connects an upper end portion of the outer wall 31 and an upper end portion of the inner wall 32. A pressed portion 34 is coupled to the door opening-side end of the outer wall 31 with a bolt. The pressed portion 34 includes a lower part extending downward beyond the outer wall 31. The lower part of the pressed portion 34 includes a contact surface 34A, which is inclined inward in the width direction X as extending toward the door closing side, and a flat surface 34B, which extends in the front-rear direction Y between the contact surface 34A and the door closing-side end. As shown in FIG. 6, the flat surface 34B and an outer surface 32A of the inner wall 32 are aligned on the same plane as viewed from below. Here, the lower sliding rail 30L has the same structure as the lower sliding rail 30R.

As shown in FIG. 5, a roller 26 is coupled to the distal end of the lower swing arm 25. The roller 26 is movable relative to the lower sliding rail 30R in the front-rear direction Y as rotating about a rotational axis extending in the height direction Z. The roller 26, which projects upward from an upper surface of the distal end of the lower swing arm 25, is located between the outer wall 31 and the inner wall 32 of the corresponding lower sliding rail.

A roller 27 is rotatably coupled to a lower surface of the lower swing arm 25 that is separated from the distal end of the lower swing arm 25 toward the door opening side. The roller 27 is movable relative to the pressed portion 34 as rotating about a rotational axis extending in the height direction Z. As shown in FIG. 6, the roller 27 is arranged to be in contact with the contact surface 34A. The roller 27 presses the pressed portion 34 toward the door closing side.

Figure 7:
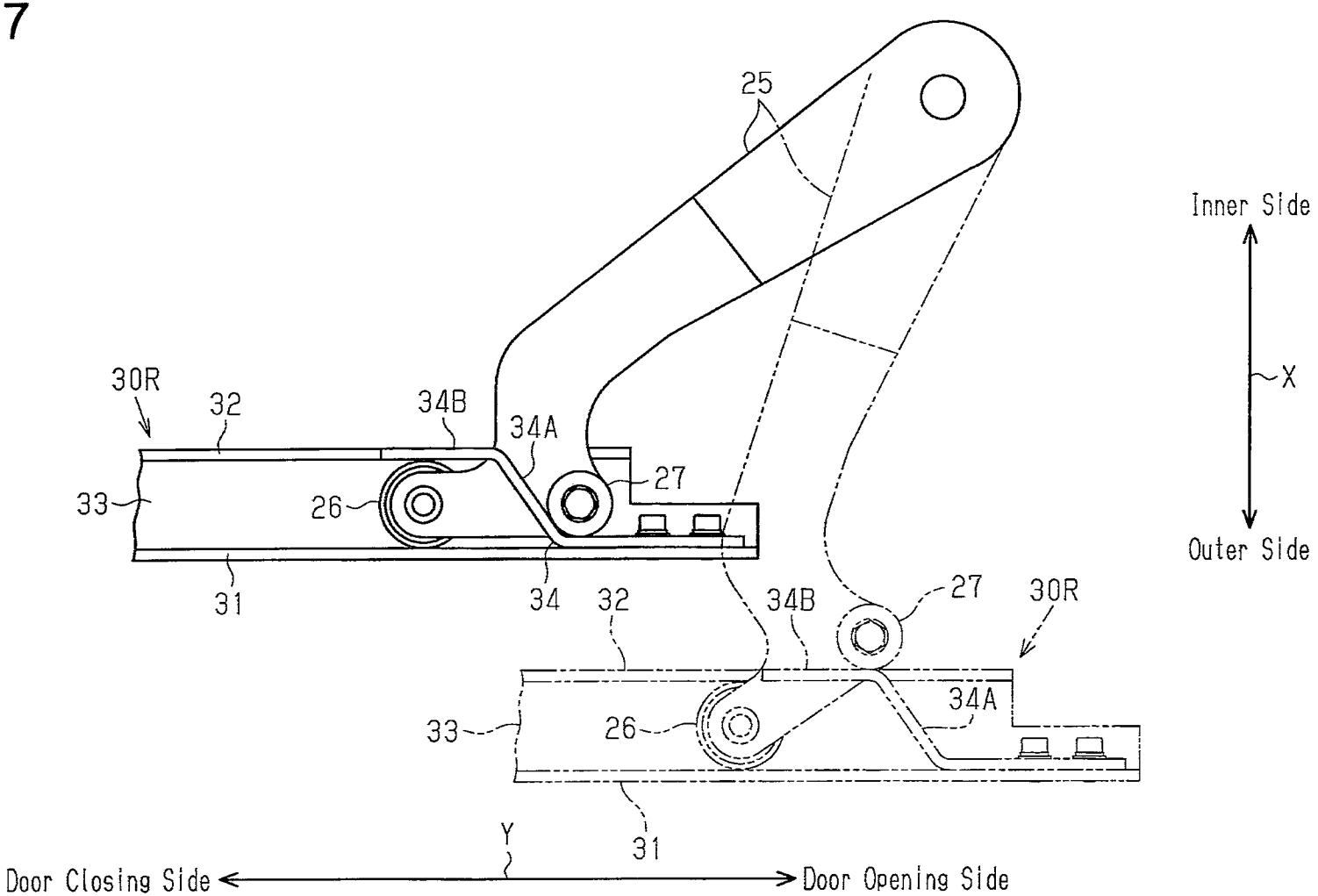
FIG. 7 is a schematic diagram illustrating the operation of the lower swing arm of FIG. 5.

As shown in FIG. 7, when the door 2R (refer to FIG. 3) moves outward and toward the door opening side, the lower swing arm 25 rotates outward and toward the door opening side so that the lower swing arm 25 indicated by the solid lines is shifted to the lower swing arm 25 indicated by the double-dashed lines. When the door 2R moves outward and toward the door opening side, the roller 26 rolls on the inner wall 32 of the lower sliding rail 30R. This moves the door 2R relative to the roller 26 and the lower swing arm 25 toward the door opening side in the front-rear direction Y. When the door 2R moves outward and toward the door opening side, the roller 27 moves inward in the width direction X along the contact surface 34A (roller 27 does not necessarily have to contact while rolling) and toward the door closing side relative to the contact surface 34A. After passing through the contact surface 34A in the front-rear direction Y, the roller 27 rolls on the flat surface 34B toward the door closing side.

Figure 8:
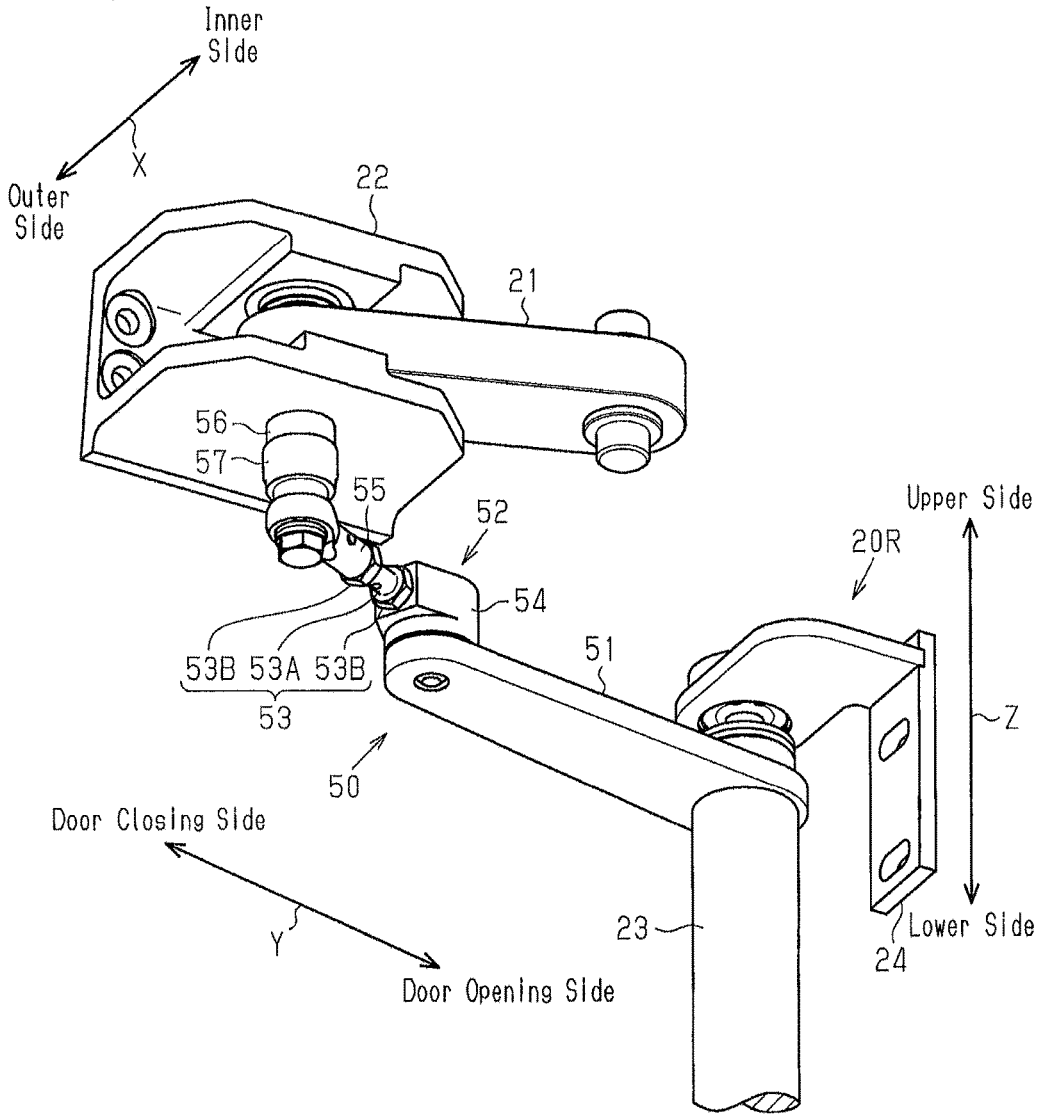
FIG. 8 is a perspective view showing a joint mechanism of the swing arm mechanism.

Referring to FIG. 8, each coupling mechanism 50 includes an upper swing arm 51 of the corresponding one of the swing arm mechanisms 20L, 20R. The upper swing arm 51 is coupled to the upper end portion of the corresponding pillar 23 below the upper bracket 24. The upper swing arm 51 is not rotatable relative to the pillar 23. The distal end of the upper swing arm 51 is coupled to the distal end of the guide arm 21 by an auxiliary arm 52. The auxiliary arm 52 is rotatable relative to the upper swing arm 51 about a rotational axis extending in the height direction Z. Each auxiliary arm 52 includes an arm length adjustment mechanism 53, which is capable of adjusting its length, that is, the distance between a basal portion 54 and a distal portion 55 of the auxiliary arm 52. Each arm length adjustment mechanism 53 includes a rod-like bolt 53A, and two nuts 53B, which are fastened to the bolt 53A. Change in the position of the nuts 53B relative to the bolt 53A changes the insertion amount of the bolt 53A into the basal portion 54 and the distal portion 55. Consequently, the length of the auxiliary arm 52 is changed. In this manner, the relative position of the auxiliary arm 52 and the guide arm 21 is adjustable when the auxiliary arm 52 is rotated relative to the upper swing arm 51 to adjust the length of the auxiliary arm 52.

The distal portion 55 of each auxiliary arm 52 is coupled to a restricted rod 56, which extends in the height direction Z. The restricted rod 56 is not rotatable relative to the distal portion 55. The upper portion of the restricted rod 56 is inserted through the arm coupling member 22 and coupled to the guide arm 21. A rod wheel 57 is coupled to an intermediate portion of the restricted rod 56. The intermediate portion is, for example, located below the arm coupling member 22 and above the auxiliary arm 52. The rod wheel 57 is rotatable around the restricted rod 56.

As shown in FIG. 4, a door support mechanism 60 is located between the two pillars 23. The door support mechanism 60 holds the doors 2L, 2R so that outward displacement of the lower end portions of the doors 2L, 2R is hindered. The door support mechanism 60 is mechanically coupled to the lock mechanism 40 and the drive mechanism 13 (refer to FIG. 2) by a lock slider 18 (refer to FIG. 9), which is coupled to the carrier of the planetary gear mechanism. The door support mechanism 60 is driven by the drive mechanism 13. When the lock mechanism 40 is in the locked state, the door support mechanism 60 limits movement of the swing arm mechanisms 20L, 20R and supports the doors 2L, 2R. More specifically, in cooperation with the switching of the lock mechanism 40 from the unlocked state to the locked state driven by the drive mechanism 13, the door support mechanism 60 hinders the outward displacement of the lower end portions of the doors 2L, 2R. The lower end portions of the doors 2L, 2R that are supported by the door support mechanism 60 and lock portions of the doors 2L, 2R that are locked by the lock mechanism 40 (refer to FIG. 3) are different from or spaced from each other in the height direction Z.

The door support mechanism 60 mainly includes a movable bracket 61, which is movable in the front-rear direction Y when the carrier of the planetary gear mechanism rotates, two coupling rods 65L, 65R, which are movable integrally with the movable bracket 61 in the front-rear direction Y, and two restriction members 66L, 66R, which are respectively fixed to the coupling rods 65L, 65R and restrict movement of the swing arm mechanisms 20L, 20R. The movable bracket 61 is located in the middle of the plug door opening-closing apparatus 10 (refer to FIG. 2) in the front-rear direction Y and at an inner side of the support frame 12 (refer to FIG. 2) in the width direction X. The coupling rod 65L extends from the movable bracket 61 to the left side in the front-rear direction Y. The coupling rod 65R extends from the movable bracket 61 to the right side in the front-rear direction Y. The restriction members 66L, 66R are each fixed to a door opening-side portion of the corresponding one of the coupling rods 65L, 65R with bolts.

Figure 9:
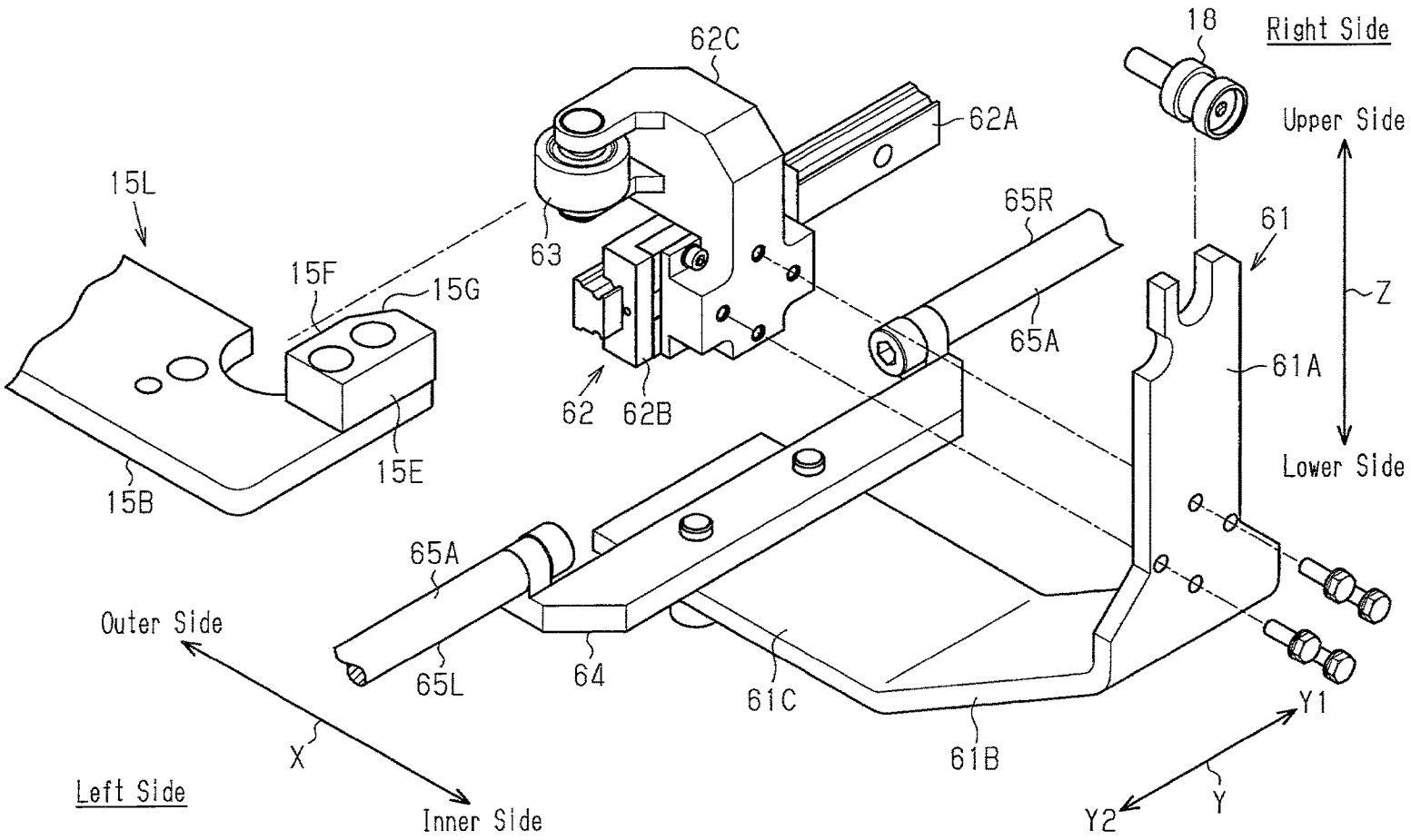
FIG. 9 is an exploded perspective view showing a movable bracket of the door support mechanism.

As shown in FIG. 9, the movable bracket 61 includes an upper coupling portion 61A, which extends in the height direction Z. The lock slider 18 is coupled to an upper end portion of the upper coupling portion 61A. An inclined portion 61B, which is inclined outward as extending downward, is continuous with a lower end portion of the upper coupling portion 61A. A lower coupling portion 61C, which extends outward, is continuous with an outer end of the inclined portion 61B in the width direction X.

A guide member 62, which guides movement of the movable bracket 61 in the front-rear direction Y, is located on a lower part of the upper coupling portion 61A at an outer side of the upper coupling portion 61A. The guide member 62 includes a rail 62A, which is coupled to a lower end portion of the support frame 12 (refer to FIG. 2), and a slider 62B, which is engaged with the rail 62A and movable relative to the rail 62A in the front-rear direction Y. The rail 62A extends in the front-rear direction Y. A connection member 62C is coupled to an inner side surface of the slider 62B in the width direction X. The connection member 62C is fastened to the lower part of the upper coupling portion 61A with bolts. The connection member 62C extends upward and outward beyond the slider 62B. A roller 63 is coupled to an upper outer end of the connection member 62C and rotatable relative to the connection member 62C about a rotational axis extending in the height direction Z. When the doors 2L, 2R (refer to FIG. 2) are completely closed, the roller 63 is in contact with an outer side surface of a block 15E, which defines a flat surface 15F. The block 15E is fixed to an upper surface of the second coupling plate 15B of the door hanger 15L.

A rod fixing member 64, which fixes a door closing-side end of each of the coupling rods 65L, 65R, is fastened to an outer end of the lower coupling portion 61C in the width direction X.

Figure 10:
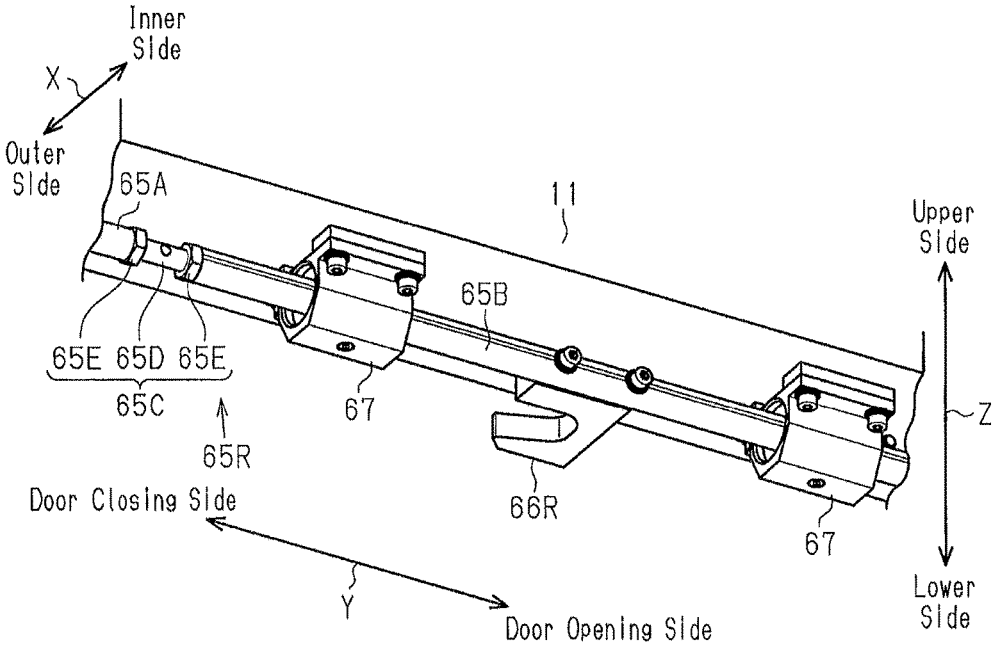
FIG. 10 is a perspective view showing a restriction member of the door support mechanism.

As shown in FIG. 10, the coupling rod 65R includes a first rod 65A, which is fixed to the rod fixing member 64 (refer to FIG. 9), a second rod 65B, to which the restriction member 66R is fixed, and a rod length adjustment mechanism 65C, which couples the first rod 65A and the second rod 65B and capable of adjusting the length of the coupling rod 65R.

The rod length adjustment mechanism 65C includes a rod-like bolt 65D and two nuts 65E, which are fastened to the bolt 65D. Change in the position of the nuts 65E relative to the bolt 65D changes the insertion amount of the bolt 65D into the first rod 65A and the second rod 65B. Consequently, the length of the coupling rod 65R is adjusted.

The second rod 65B is supported by two tubular support members 67. The support members 67 support the second rod 65B at the front and rear of the restriction member 66R. The second rod 65B is inserted through the support members 67. The support members 67 are coupled to a lower surface of the base 11. The structure of the coupling rod 65L and the structure in which the coupling rod 65L is supported by support members 67 are the same as those of the coupling rod 65R.

Figure 11:
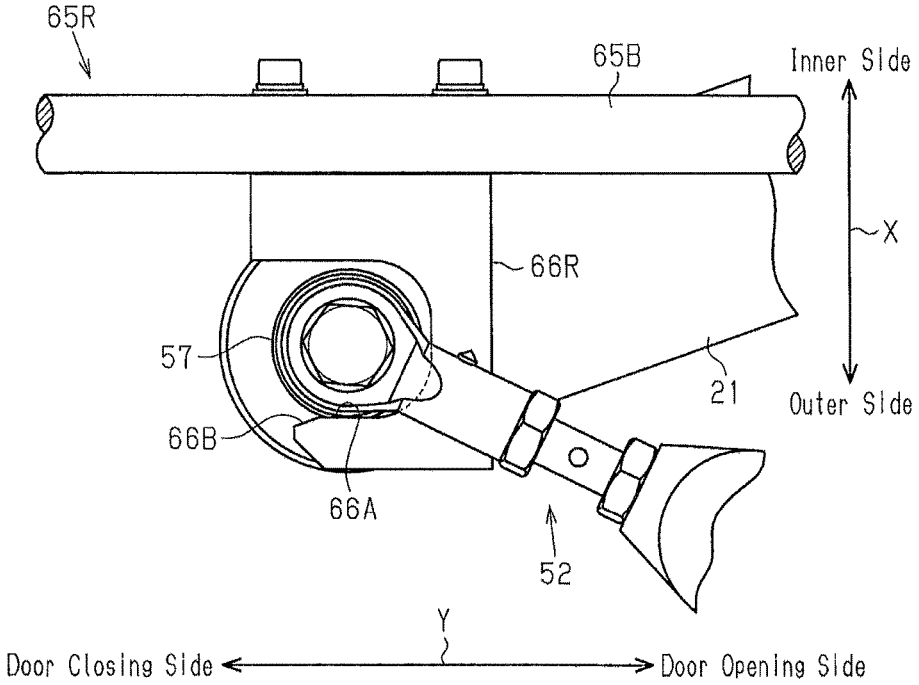
FIG. 11 is an enlarged view of the restriction member.

As shown in FIG. 11, the restriction member 66R is located at an outer side of the coupling rod 65R. The restriction member 66R is recessed and opens toward the door closing side. An outer portion of the restriction member 66R includes a flat surface 66A, which extends in the front-rear direction Y. The door closing-side end of the flat surface 66A is continuous with an inclined surface 66B, which is inclined outward in the width direction X as extending away from the flat surface 66A. As shown in FIG. 11, when the doors 2L, 2R (refer to FIG. 2) are completely closed, the rod wheel 57 is in contact with the flat surface 66A.

The structure and operation of the lock mechanism 40 will now be described with reference to FIGS. 12 and 13. It is preferred that the lock mechanism 40 operates when the doors 2L, 2R are completely closed and does not operate otherwise.

Figure 12:
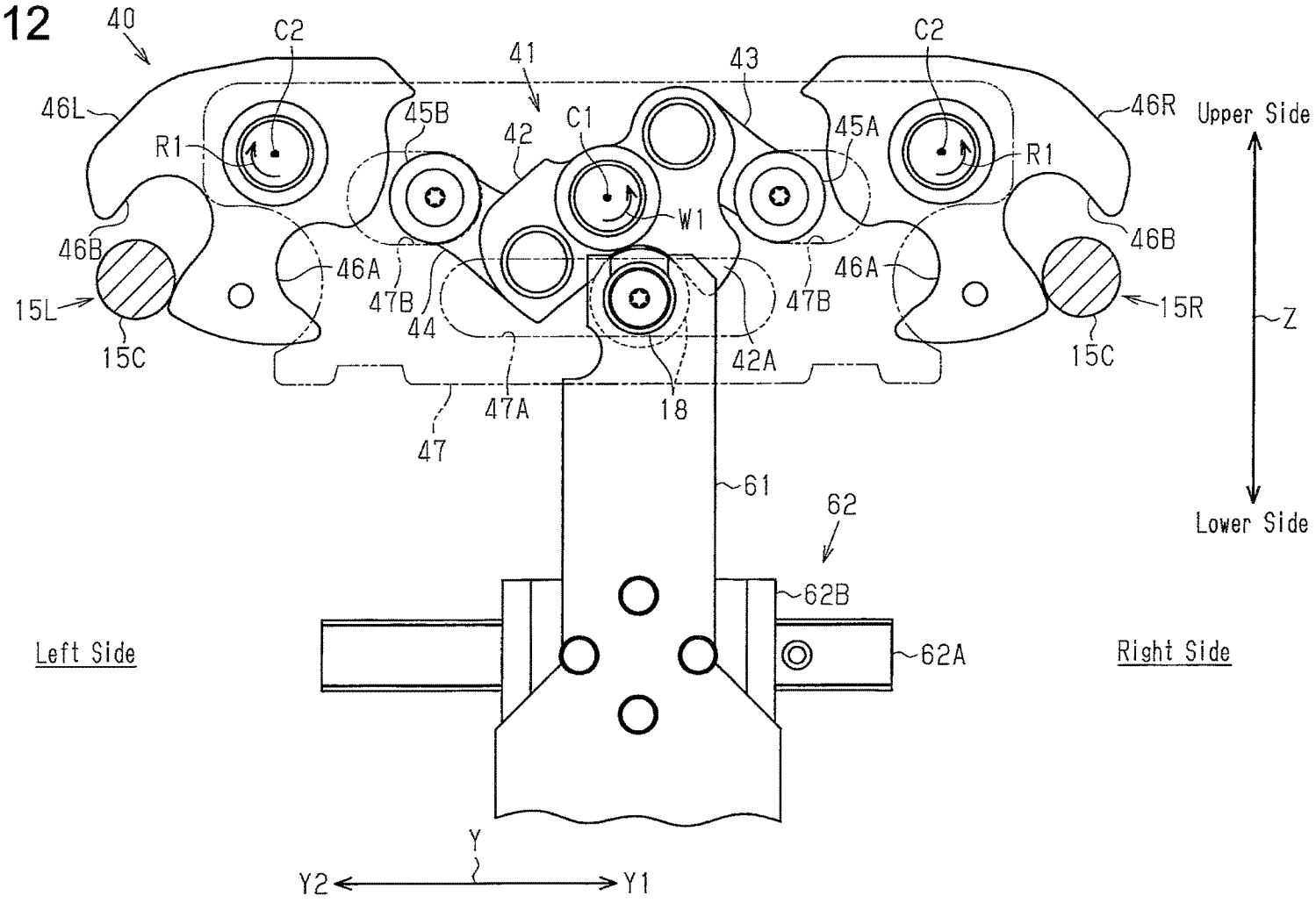
FIG. 12 is a front view of a lock mechanism in an unlocked state.

As shown in FIG. 12, the lock mechanism 40 includes a link mechanism 41 and two actuation members 46L, 46R. The link mechanism 41 may be shifted between a bent state shown in FIG. 12 and a straight state shown in FIG. 13. When the link mechanism 41 is shifted between the bent state and the straight state, the actuation members 46L, 46R are actuated. The lock mechanism 40 also includes a guide plate 47, which is indicated by the double-dashed lines in the drawing. The guide plate 47, which is located beside the link mechanism 41 and the actuation members 46L, 46R at the inner side in the width direction X, guides movement of the link mechanism 41 and the lock slider 18. The lock slider 18 is inserted into a lower portion of the guide plate 47, which defines a first guide hole 47A that guides movement of the lock slider 18 in the front-rear direction Y.

The link mechanism 41 includes three coupled links 42, 43, 44. The center link 42 is rotatable about a rotational center C1, which is located in a longitudinally middle portion. A projection 42A projects from the edge of a longitudinally middle portion of the link 42 in a direction separating away from the rotational center C1. The link 43 is coupled to a longitudinally right end of the link 42 and rotatable relative to the link 42. The link 44 is coupled to a longitudinally left end of the link 42 and rotatable relative to the link 42. Pressing portions 45A, 45B are fixed to the distal ends of the links 43, 44, respectively. The pressing portions 45A, 45B are partially inserted into second guide holes 47B, which are formed in the guide plate 47 and elongated in the front-rear direction Y defining the longitudinal direction.

The actuation members 46L, 46R are respectively located at positions beside the links 42, 42 in the front-rear direction Y. Each of the actuation members 46L, 46R includes a first constraining portion 46A, which constrains the corresponding one of the pressing portions 45A, 45B, and a second constraining portion 46B, which constrains the shaft 15C of the corresponding one of the door hangers 15L, 15R. The actuation members 46L, 46R are each rotatable about a rotational center C2.

A return spring (not shown) is coupled to the outer side surface of each of the actuation members 46L, 46R in the width direction X. The return springs apply force, which returns the actuation members 46L, 46R from the position when the lock mechanism 40 is straight to the position when the lock mechanism 40 is bent, to the actuation members 46L, 46R. One example of the return spring is a coil spring.

Figure 13:
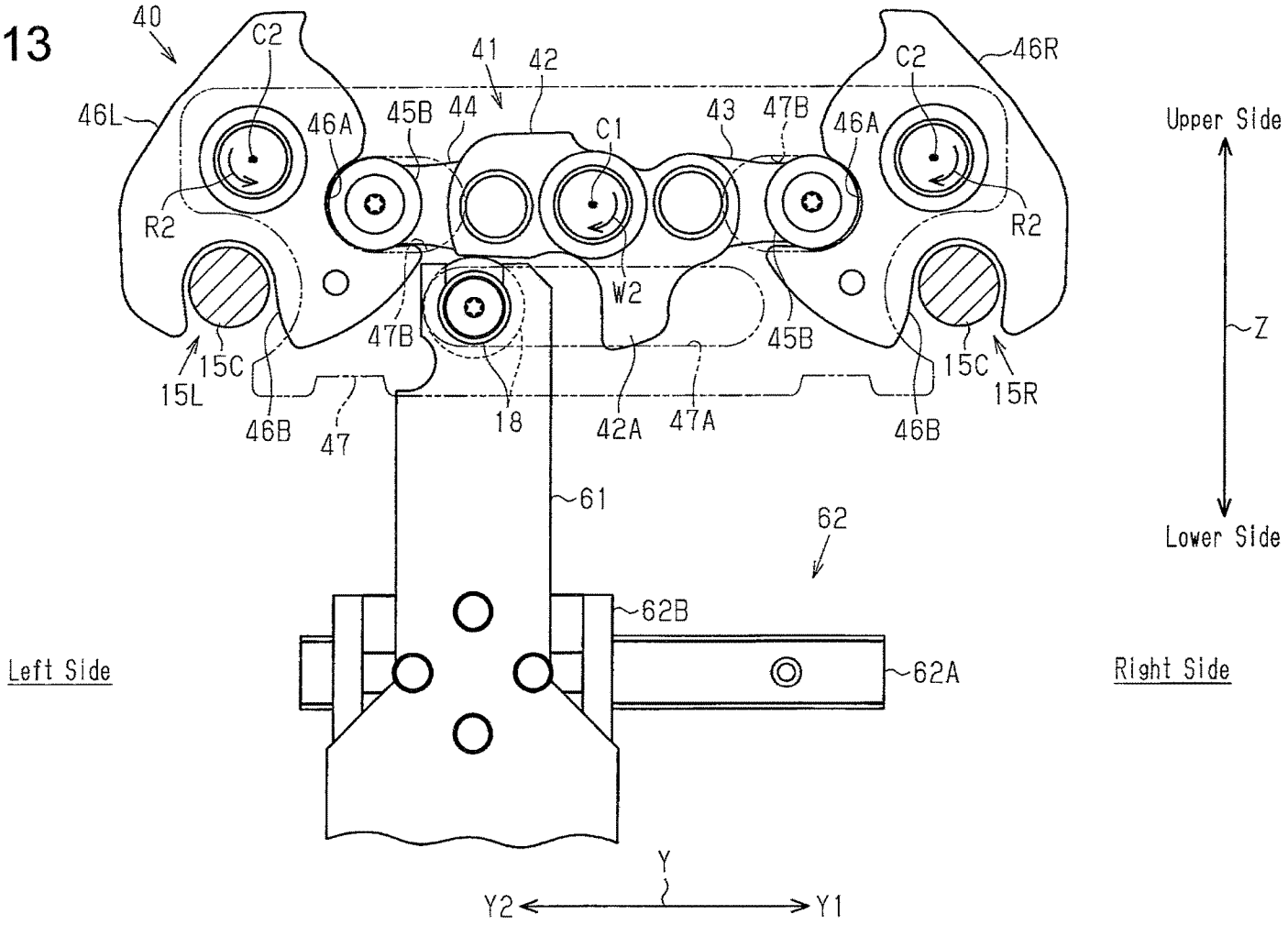
FIG. 13 is a front view of the lock mechanism in a locked state.

When the lock mechanism 40 is in the locked state as shown in FIG. 13 and the output shaft of the motor of the drive mechanism 13 (refer to FIG. 2) rotates forward, the carrier rotates forward and the lock slider 18 moves in the first guide hole 47A in an unlocking direction Y1 of the front-rear direction Y. Then, as shown in FIG. 12, when the lock slider 18 pushes the projection 42A of the link 42 in the unlocking direction Y1, the link 42 rotates about the rotational center C1 in a first direction W1. The rotation of the link 42 rotates the links 43, 44 and separates the pressing portions 45A, 45B from the corresponding actuation members 46L, 46R along the second guide holes 47B in the front-rear direction Y. Consequently, the return springs rotate the actuation members 46L, 46R about the rotational center C2 in a return direction R1. As a result, the lock mechanism 40 is bent as shown in FIG. 12. At this time, the first constraining portions 46A of the actuation members 46L, 46R do not constrain the shafts 15C of the door hangers 15L, 15R. Thus, the lock mechanism 40 is in the unlocked state.

When the lock mechanism 40 is in the unlocked state as shown in FIG. 12 and the output shaft of the motor of the drive mechanism 13 rotates backward, the carrier rotates backward and the lock slider 18 moves in a locking direction Y2 of the front-rear direction Y. Then, as shown in FIG. 13, when the lock slider 18 pushes a portion coupling the link 42 and the link 44 in the locking direction Y2, the link 42 rotates about the rotational center C1 in a second direction W2, which is opposite to the first direction W1. The rotation of the link 42 rotates the links 43, 44. Then, the pressing portions 45A, 45B move toward the corresponding actuation members 46L, 46R in the front-rear direction Y and press the actuation members 46L, 46R in the front-rear direction Y. Consequently, the actuation members 46L, 46R rotate about the rotational center C2 in a rotational direction R2, which is opposite to the return direction R1, against the force of the return springs. As a result, the lock mechanism 40 becomes straight as shown in FIG. 13. At this time, the second constraining portions 46B of the actuation members 46L, 46R constrain the pressing portions 45A, 45B, and the first constraining portions 46A constrain the shafts 15C of the door hangers 15L, 15R. Thus, the lock mechanism 40 is in the locked state.

The operation and effect of the door support mechanism 60 will now be described with reference to FIGS. 14 to 16. In the description, hereafter, the "unlocked position" refers to a position of the movable bracket 61 when the lock mechanism 40 is in the unlocked state, and the "locked position" refers to a position of the movable bracket 61 when the lock mechanism 40 is in the locked state.

The entire operation of the door support mechanism 60 will now be described.

Figure 14A:
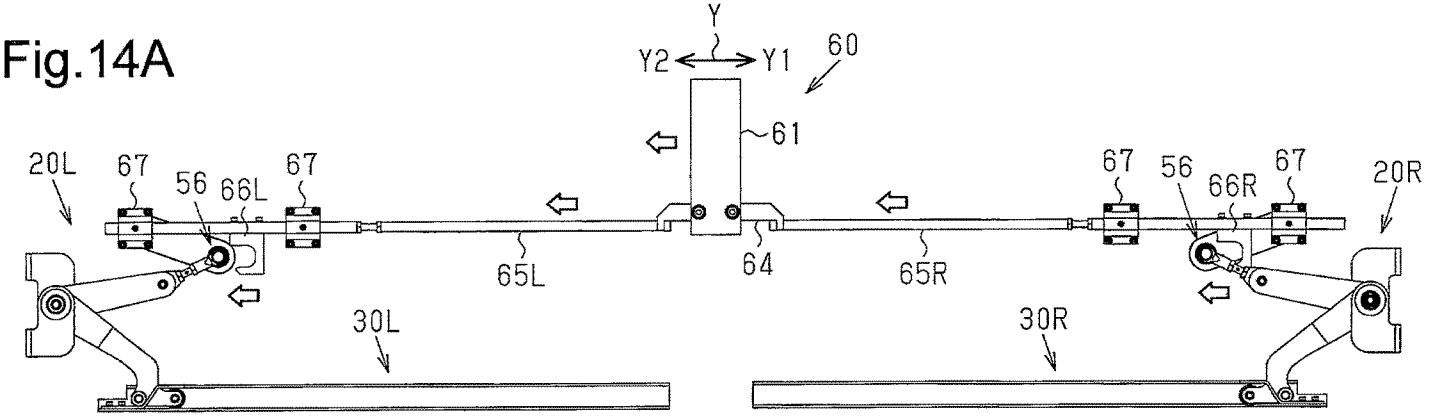
FIG. 14A is a bottom view of the door support mechanism and the swing arm mechanism when the lock mechanism is in the unlocked state.

As shown in FIG. 14A, when the lock mechanism 40 (refer to FIG. 12) is in the unlocked state, the restriction members 66L, 66R are located at a non-restriction position where the restriction members 66L, 66R are separated from the restricted rods 56 in the front-rear direction Y and do not restrict movement of the swing arm mechanisms 20L, 20R.

When the lock mechanism 40 is switched from the unlocked state to the locked state, the lock slider 18 (refer to FIG. 12) moves from the unlocked position in the locking direction Y2 and the movable bracket 61, which is coupled to the lock slider 18, moves from the unlocked position in the locking direction Y2. In this case, the coupling rods 65L, 65R move integrally with the movable bracket 61 in the locking direction Y2. Consequently, the restriction members 66L, 66R, which are coupled to the coupling rods 65L, 65R, move from the non-restriction position in the locking direction Y2.

Figure 14B:
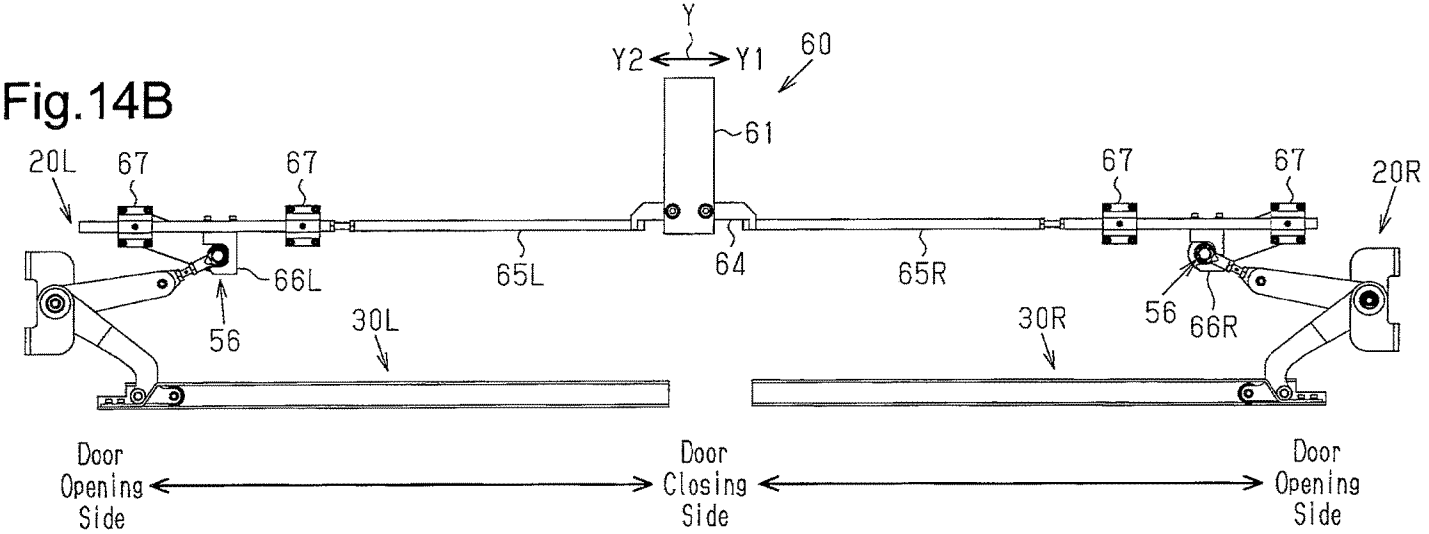
FIG. 14B is a bottom view of the door support mechanism and the swing arm mechanism when the lock mechanism is in the locked state.

Then, as shown in FIG. 14B, when the lock mechanism 40 is in the locked state, the movable bracket 61 is in the locked position, and the restriction members 66L, 66R are at a restriction position. Thus, the restriction members 66L, 66R constrain the restricted rods 56 in the width direction X.

The operation of the roller 63, which is coupled to the movable bracket 61, will now be described.

Figure 15:
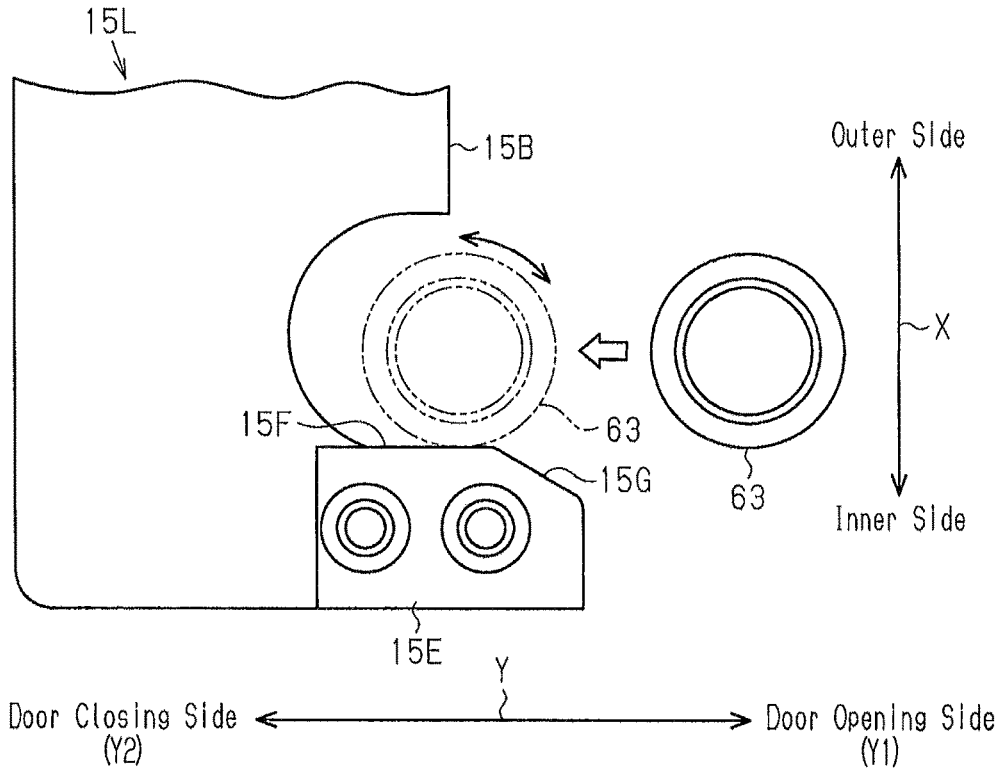
FIG. 15 is a schematic diagram illustrating the coupling of the movable bracket and a roller.

As shown in FIG. 15, when the movable bracket 61 (refer to FIG. 14) moves from the unlocked position in the locking direction Y2, the roller 63, which is coupled to the movable bracket 61, moves integrally with the movable bracket 61 in the locking direction Y2. Then, the roller 63 comes in contact with the inclined surface 15G of the block 15E of the door hanger 15L and is guided toward the flat surface 15F. The roller 63 is in contact with the flat surface 15F when moving in the locking direction Y2. At this time, the roller 63 rolls on the inclined surface 15G and the flat surface 15F. When the movable bracket 61 is in the locked position, the roller 63 is in contact with the flat surface 15F as indicated by the double-dashed lines in the drawing.

The operation of the restriction members 66L, 66R will now be described.

Figure 16:
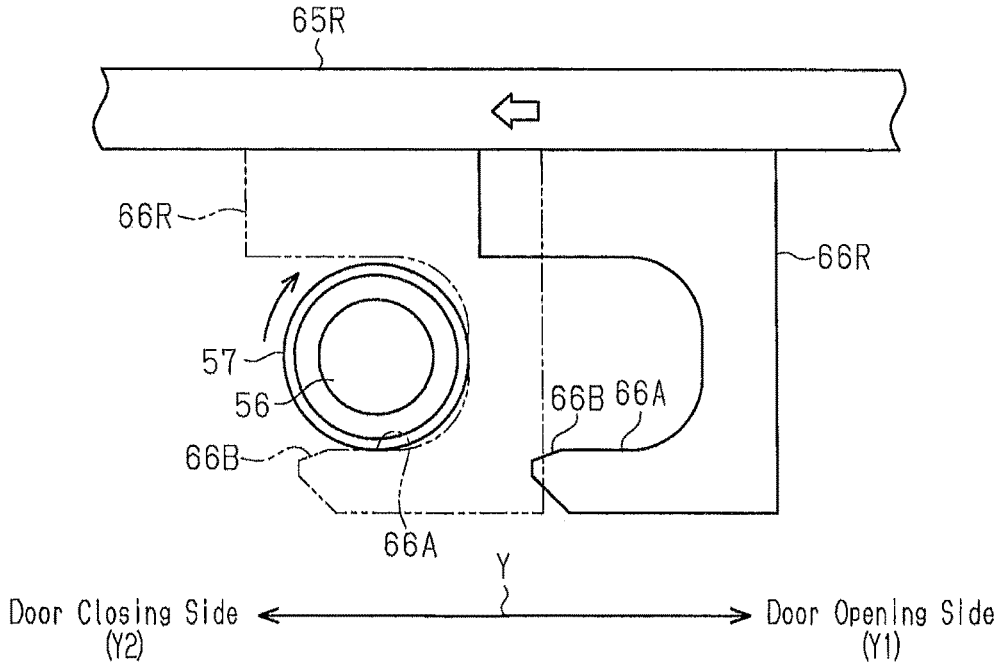
FIG. 16 is a bottom view of the restriction member.

As shown in FIG. 16, when the restriction member 66R, which is located at the non-restriction position indicated by the solid lines, moves in the locking direction Y2, the restriction member 66R becomes proximate to the restricted rod 56. The rod wheel 57, which is coupled to the restricted rod 56, comes in contact with the inclined surface 66B of the restriction member 66R and is guided to the flat surface 66A as the restriction member 66R moves in the locking direction Y2. At this time, the rod wheel 57 rolls on the inclined surface 66B and the flat surface 66A. When the movable bracket 61 is located in the locked position, the restriction member 66R moves to the restriction position, which is the position of the restriction member 66R indicated by the double-dashed lines. In this case, the rod wheel 57 is in contact with the flat surface 66A but separated from a portion of the restriction member 66R that is opposed to the flat surface 66A in the width direction X having a gap located in between in the width direction X.

When the restriction member 66R constrains the rod wheel 57, the restricted rod 56 is constrained by the restriction member 66R. This restricts rotation of the guide arm 21 and the upper swing arm 51 (refer to FIG. 14), which are coupled to the restricted rod 56. Movement of the restriction member 66R in the front-rear direction Y is restricted by the movable bracket 61 and the coupling rod 65R due to the lock mechanism 40. Additionally, restriction in the rotation of the upper swing arm 51 restricts rotation of the pillar 23, which is coupled to the upper swing arm 51, and the lower swing arm 25 (refer to FIG. 14), which is coupled to the pillar 23. Thus, even when force that presses the door 2R (refer to FIG. 2) outward is applied to the lower end portion of the door 2R, the lower swing arm 25 do not rotate. This limits the displacement of the lower end portion of the door 2R. Here, the restriction member 66L performs the same operation as the restriction member 66R. Thus, even when force that presses the door 2L outward is applied to the lower end portion of the door 2L, the displacement of the lower end portion of the door 2L is limited.

The plug door device 1 of the embodiment has the advantages described below.

(1) The plug door device 1 includes the door support mechanism 60, which hinders the outward displacement of the lower end portions of the doors 2L, 2R. Thus, even when the doors 2L, 2R receive large force that presses the doors 2L, 2R outward, the outward displacement of the lower end portions of the doors 2L, 2R is hindered. Also, the formation of a gap between the vehicle side wall 210 and the doors 2L, 2R is limited. The rigidity of the doors 2L, 2R and the lock mechanism 40 does not necessarily have to be improved.

(2) The door support mechanism 60 supports the doors 2L, 2R by restricting movement of the swing arm mechanisms 20L, 20R. Thus, the door support mechanism 60 may be located on the edge of the vehicle side wall 210, which is adjacent to the entrance 211. The door support mechanism 60 does not cause decreases in the open area of the entrance 211, and the entrance 211 of the vehicle side wall may be widened.

(3) The flat surfaces 66A of the restriction members 66L, 66R of the door support mechanism 60 are each in contact with the rod wheel 57 of the corresponding restricted rod 56 when the restriction members 66L, 66R are located at the restriction position. Thus, when the restriction members 66L, 66R are located at the restriction position, the restricted rods 56 do not move outward. This further limits movement of the swing arm mechanisms 20L, 20R compared to when gaps are formed between the flat surfaces 66A of the restriction members 66L, 66R and the rod wheels 57. Thus, the formation of a gap between the vehicle side wall 210 and the doors 2L, 2R is further limited.

(4) The drive mechanism 13 of the plug door opening-closing apparatus 10 is located on the upper portions of the doors 2L, 2R. The restriction members 66L, 66R restrict rotation of the upper swing arms 51 of the swing arm mechanisms 20L, 20R. Thus, the drive mechanism 13 and the restriction members 66L, 66R may be located close to each other compared to a structure in which the restriction members 66L, 66R restrict rotation of lower portions of the swing arm mechanisms 20L, 20R, for example, the lower swing arms 25. This allows the drive force to be easily transmitted from the drive mechanism 13 to the restriction members 66L, 66R.

(5) The door support mechanism 60 includes the movable bracket 61 and the coupling rods 65L, 65R, which couple the drive mechanism 13 and the lock mechanism 40 to the restriction members 66L, 66R. This stabilizes the operation of the door support mechanism 60 compared to a structure in which the drive mechanism 13 and the lock mechanism 40 are coupled to the restriction members 66L, 66R, for example, by wires.

(6) The coupling rods 65L, 65R each include the rod length adjustment mechanism 65C. Thus, the position of the restriction members 66L, 66R is adjustable relative to the restricted rods 56 in the front-rear direction Y by adjusting the length of the coupling rods 65L, 65R. This allows the position of the restriction members 66L, 66R to be easily changed even after the plug door opening-closing apparatus 10 is assembled so that the displacement in the width direction X is further appropriately limited in the lower end portions of the doors 2L, 2R.

(7) The support members 67 are adapted to support the coupling rods 65L, 65R and hinder outward deformation of the coupling rods 65L, 65R. Thus, the outward deformation of the coupling rods 65L, 65R is limited. This hinders displacement of the restriction members 66L, 66R relative to the swing arm mechanisms 20L, 20R. Thus, the restriction members 66L, 66R appropriately maintain the function to restrict movement of the swing arm mechanisms 20L, 20R.

(8) The support members 67 support the coupling rods 65L, 65R at the front and rear of the restriction members 66L, 66R. This further hinders deformation of the coupling rods 65L, 65R in the width direction X when large force is applied from the swing arm mechanisms 20L, 20R to the restriction members 66L, 66R.

(9) The guide member 62, which guides movement of the movable bracket 61 in the front-rear direction Y, is coupled to the movable bracket 61. Thus, when force is applied to the doors 2L, 2R, the guide member 62 receives the force. This hinders the force applied to the doors 2L, 2R from being transmitted to the lock mechanism 40. Thus, the lock mechanism 40 is stably maintained in the locked state. Additionally, the guide member 62 smoothly moves the movable bracket 61 in the front-rear direction Y. Thus, the lock mechanism 40 is smoothly switched to the locked state and the unlocked state. This reduces the load particularly when an operator manually switches the state.

(10) The restriction members 66L, 66R and the coupling rods 65L, 65R correspond to the swing arm mechanisms 20L, 20R, respectively. Thus, the restriction members 66L, 66R can be moved by moving the coupling rods 65L, 65R. In particular, since the coupling rods 65L, 65R are coupled to the movable bracket 61, the coupling rods 65L, 65R can be integrally moved by moving the movable bracket 61. This simplifies the task for manually opening and closing the doors 2L, 2R compared to when an operator individually moves the restriction members 66L, 66R.

(11) The restriction members 66L, 66R restrict rotation of the upper swing arms 51 using the restricted rods 56. Thus, the force necessary to restrict movement of the swing arm mechanisms 20L, 20R is decreased compared to when the door support mechanism 60 directly applies force to the pillars 23. This eliminates the need for increasing the rigidity of the door support mechanism 60. Thus, the door support mechanism 60 may be reduced in size. Additionally, rotation of the lower swing arms 25 is restricted in addition to rotation of the upper swing arms 51. This hinders the formation of gaps between the lower end portions of the doors 2L, 2R and the vehicle side wall 210.

(12) When the lock mechanism 40 locks the doors, the roller 27 of each lower swing arm 25 presses the pressed portion 34 toward the door closing side. This limits displacement of the lower end portions of the doors 2L, 2R toward the door opening side. In particular, the door support mechanism 60 restricts rotation of the lower swing arms 25 when the doors are locked. Thus, the roller 27 stably presses the pressed portion 34.

(13) The lower sliding rails 30L, 30R support the rollers 26 of the lower swing arms 25 in the width direction X. Each pressed portion 34 includes the contact surface 34A, which is in contact with the roller 27 of the corresponding lower swing arm 25 and inclined inward in the width direction X as extending in the door closing side. Thus, when the doors 2L, 2R move in the front-rear direction Y, the lower sliding rails 30L, 30R smoothly move relative to the rollers 26. Additionally, when the doors 2L, 2R are completely closed, the roller 26 of each lower swing arm 25 receives an outward component of the force acting from the roller 27 to the pressed portion 34. This limits outward displacement of the lower end portions of the doors 2L, 2R.

(14) Since each restricted rod 56 extends in the height direction Z, the position in which each of the restriction members 66L, 66R contacts the restricted rod 56 may be selected from a range of the length of the restricted rod 56. This increases the degree of freedom for designing the position in which the restriction members 66L, 66R are located in the height direction Z.

(15) When the restriction members 66L, 66R move from the non-restriction position to the restriction position, the rod wheels 57 are in contact with the restriction members 66L, 66R when rotating. This decreases friction force between the restriction members 66L, 66R and the rod wheels 57. Thus, the restriction members 66L, 66R smoothly come in contact with and separate from the restricted rods 56.

(16) Each restricted rod 56 is coupled by the guide arm 21 and the upper swing arm 51. This hinders deformation of the restricted rod 56 when force is applied to the restricted rod 56 in the width direction X and the front-rear direction Y. Thus, movement of the upper swing arms 51 of the swing arm mechanisms 20L, 20R may be stably restricted.

(17) Each restricted rod 56 is rotatably coupled to the upper swing arm 51 and coupled to the auxiliary arm 52, which adjusts the position relative to the guide arm 21. Thus, even when errors in the rotational positions of the upper swing arms 51 and the guide arms 21 occur, such errors may be offset by rotating the auxiliary arms 52 relative to the upper swing arms 51 during the assembling of the swing arm mechanisms 20L, 20R.

(18) The arm length adjustment mechanism 53 of each auxiliary arm 52 allows for adjustment in the position of the restricted rod 56 relative to the corresponding one of the restriction members 66L, 66R by adjusting the length of the auxiliary arm 52. Thus, even after the plug door opening-closing apparatus 10 is assembled, the position of the restricted rods 56 may be easily changed so that displacement of the lower end portions of the doors 2L, 2R is appropriately limited in the width direction X.

(19) The restriction members 66L, 66R each include the flat surface 66A. Thus, even when force that presses the restriction members 66L, 66R outward is applied from the restricted rods 56 to the restriction members 66L, 66R, the formation of a component of the force, which acts in the front-rear direction Y, is limited. This decreases situations in which the restriction members 66L, 66R are moved to the non-restriction position due to the force applied to the doors 2L, 2R or the like in the locked state.

(20) The restriction members 66L, 66R each include the inclined surface 66B. When the restriction members 66L, 66R move from the non-restriction position to the restriction position, the inclined surface 66B of each of the restriction members 66L, 66R comes in contact with the rod wheel 57 of the restricted rod 56. Thus, the rod wheel 57 and the restricted rod 56 are moved along the inclined surface 66B and guided to the flat surface 66A of the corresponding one of the restriction members 66L, 66R. This smoothly moves the restricted rod 56 and the rod wheel 57 to the flat surface 66A.

(21) The drive mechanism 13 functions as a drive source for moving the doors 2L, 2R and also a drive source for switching the lock mechanism 40 between the locked state and the unlocked state.

The drive force (e.g., output of motor) of the drive mechanism 13 for moving the doors 2L, 2R is larger than the drive force that is output from a drive source dedicated to a lock mechanism. Such a large drive force is used to drive the door support mechanism 60. Thus, outward displacement of the lower end portions of the doors 2L, 2R is limited in a further ensured manner. Additionally, the number of the drive sources in the plug door opening-closing apparatus 10 may be reduced compared to when the drive source dedicated to the lock mechanism is provided.

(22) When the doors 2L, 2R are completely closed, the roller 63, which is coupled to the connection member 62C of the guide member 62, is in contact with the flat surface 15F, which is defined by the outer surface of the block 15E of the door hanger 15L. This limits outward movement of the door hanger 15L. Accordingly, outward movement of the upper portions of the door 2L and the door 2R, which moves in accordance with the door 2L, may be limited.

Additionally, when the movable bracket 61 moves in the front-rear direction Y, the roller 63 is in contact with the flat surface 15F when rotating. This decreases the friction force between the roller 63 and the block 15E. Thus, the roller 63 smoothly comes in contact with and separates from the block 15E.

(23) The block 15E includes the inclined surface 15G. When the movable bracket 61 moves from the unlocked position toward the locked position, the roller 63 comes in contact with the inclined surface 15G. Thus, the roller 63 is moved along the inclined surface 15G and guided to the flat surface 15F of the block 15E. This smoothly moves the roller 63 to the flat surface 15F.

It should be apparent to those skilled in the art that the present invention may be embodied in many other specific forms without departing from the scope of the invention. Particularly, it should be understood that the present invention may be embodied in the following forms.

The door support mechanism 60 may have any structure for supporting the doors 2L, 2R and be modified as follows.

Figure 17:
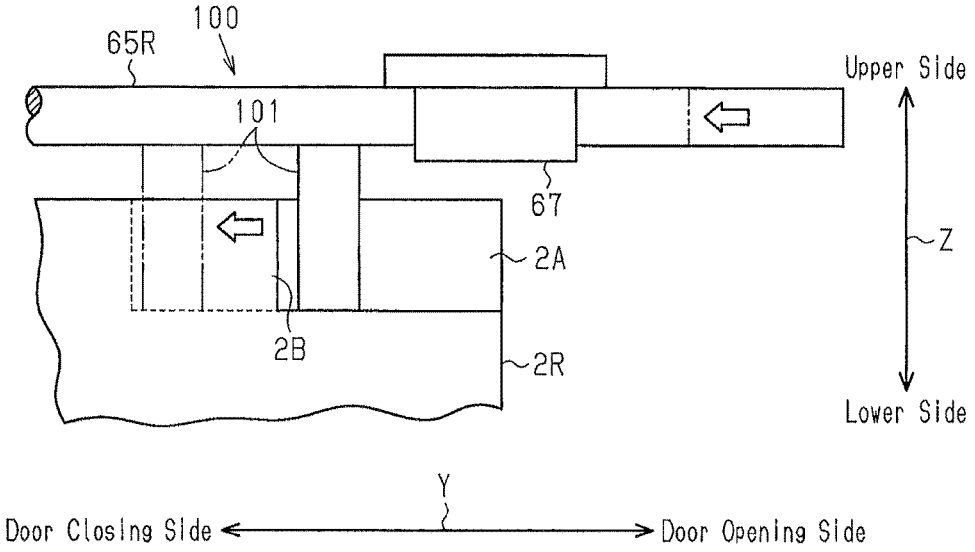
FIG. 17 is a schematic diagram illustrating a modified example of a door support mechanism.

FIG. 17 shows a door support mechanism 100, which includes a restriction rod 101 instead of the restriction member 66R. The door support mechanism 100 supports a door lower portion, which is located at a lower position than a portion fixing the door hanger 15R (refer to FIG. 2) and the door 2R, with the restriction rod 101. The restriction rod 101 is coupled to the coupling rod 65R and extends downward from the coupling rod 65R. The upper end portion of the door 2R includes a slit 2A, which opens upward and inward in the width direction X, and a restricted wall 2B, which is formed on a door closing-side end of the slit 2A in the front-rear direction Y. The restricted wall 2B is formed on an inner end of the door 2R in the width direction X.

When located at a non-restriction position, which is indicated by the solid lines, the restriction rod 101 does not limit outward displacement of the door 2R. When the restriction rod 101 is located at a restriction position, which is indicated by the double-dashed lines, the restriction rod 101 and the restricted wall 2B overlap in the width direction X. Thus, when the door 2R receives force acting to displace the door 2R outward, the restriction rod 101 contacts the restricted wall 2B and supports the door 2R. This limits outward displacement of the door 2R.

Additionally, the door support mechanism 100 includes a restriction rod 101 instead of the restriction member 66L. In the same manner as the door 2R, the door 2L includes a slit 2A and a restricted wall 2B. Thus, outward displacement of the door 2L is limited in the same manner as the door 2R.

Figure 18:
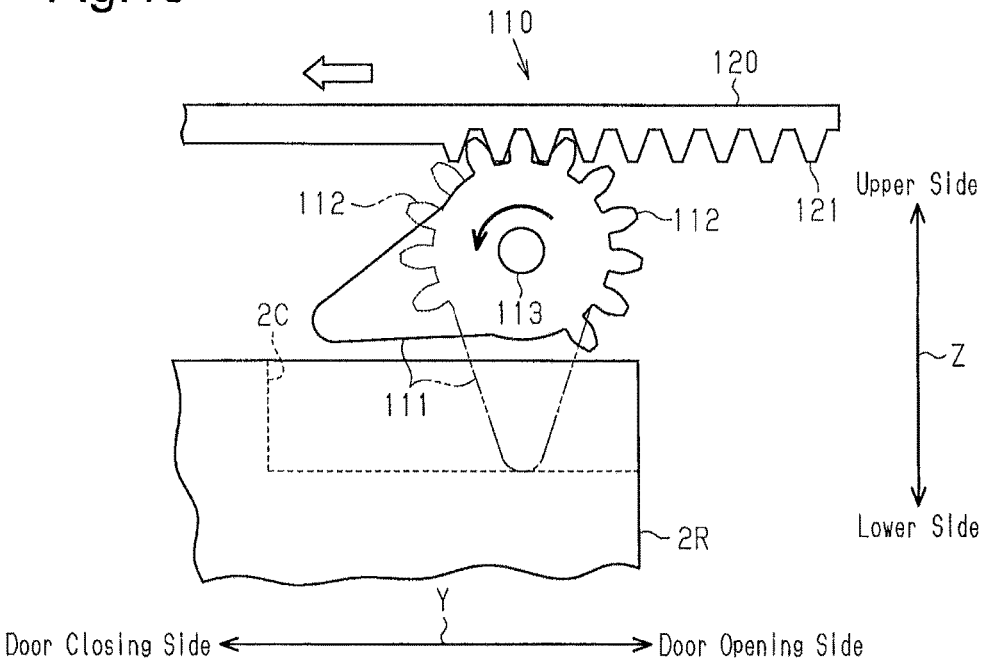
FIG. 18 is a schematic diagram illustrating a modified example of a door support mechanism.

FIG. 18 shows a door support mechanism 110, which includes a cam 111 instead of the restriction member 66R. The door support mechanism 110 supports a door lower portion, which is located at a lower position than a portion fixing the door hanger 15R (refer to FIG. 2) and the door 2R, with the cam 111. The circumference of the cam 111 includes a gear 112, which is engaged with a rack gear 121 formed on a door opening-side end of a coupling rod 120. The cam 111 is rotatably coupled to a rotation shaft 113, which is fixed to the vehicle side wall 210 (refer to FIG. 1). Additionally, the upper end portion of the door 2R is provided with a receptacle 2C, which opens upward.

When located at a non-restriction position, which is indicated by the solid line, the cam 111 is not located in the receptacle 2C. Thus, outward displacement of the door 2R is not limited. When the cam 111 moves in a direction indicated by the white arrow in the drawing, the rack gear 121 pushes the gear 112. This rotates the cam 111 in a direction indicated by the bold arrow. Consequently, the cam 111 is located at a restriction position, which is indicated by the double-dashed line. In this case, the cam 111 is located in the receptacle 2C of the door 2R. Thus, when the door 2R receives force acting to displace the door 2R outward, the cam 111 comes in contact with a wall defining the receptacle 2C of the door 2R and supports the door 2R. This limits outward displacement of the door 2R.

Additionally, the door support mechanism 110 includes a cam 111 and a coupling rod 120 instead of the coupling rod 65L and the restriction member 66L. Thus, outward displacement of the door 2L is limited in the same manner as the door 2R.

Figure 19A:
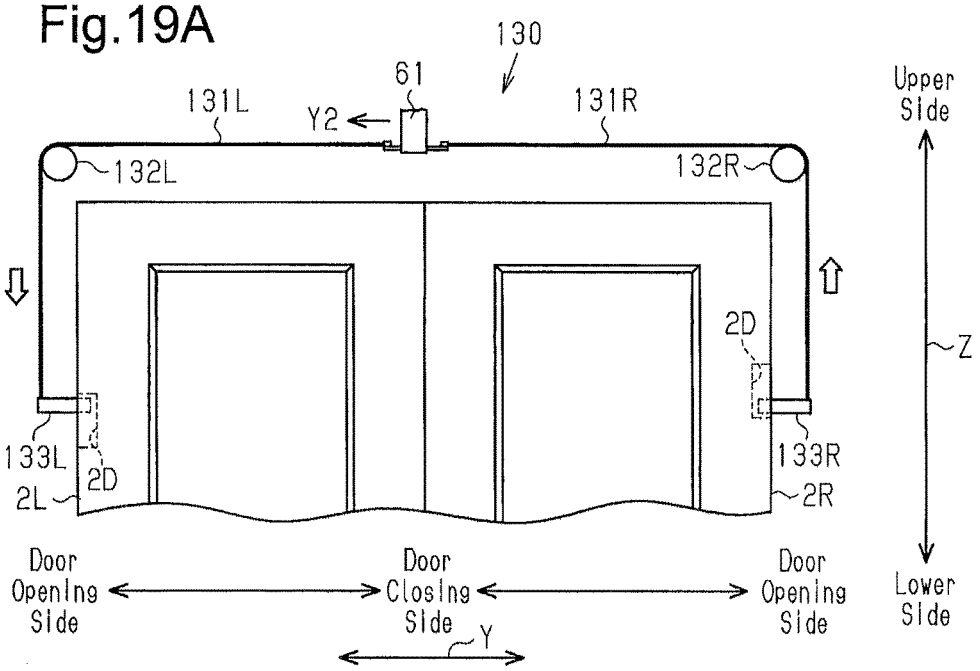
FIG. 19A is a schematic diagram illustrating a modified example of a door support mechanism.

FIG. 19A shows a door support mechanism 130 including two wires 131L, 131R coupled to the movable bracket 61, two pulleys 132L, 132R respectively supporting the wires 131L, 131R, and pins 133L, 133R coupled to ends of the wires 131L, 131R. The doors 2L, 2R are each provided with a receptacle 2D, which opens toward the door closing side and is located in a middle portion, with respect to the height direction Z, of the door opening side end of the corresponding one of the doors 2L, 2R. The pins 133L, 133R are each inserted into the receptacle 2D.

Figure 19B:
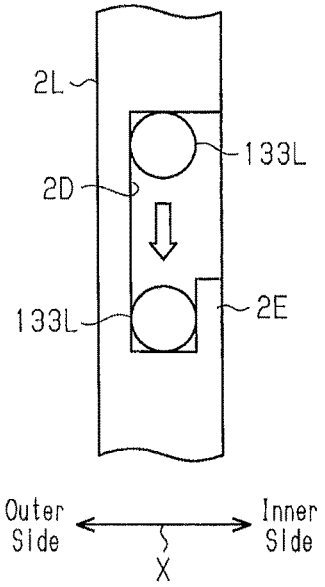
FIG. 19B is a side view showing a portion of a left door of FIG. 19A.

As shown in FIG. 19B, when the movable bracket 61 is in the unlocked position, the pin 133L is located in an upper end portion of the receptacle 2D of the door 2L, which functions as a non-restriction position. The upper end portion of the receptacle 2D of the door 2L opens inward in the width direction X. Thus, the pin 133L does not support to limit outward displacement of the door 2L.

Figure 19C:
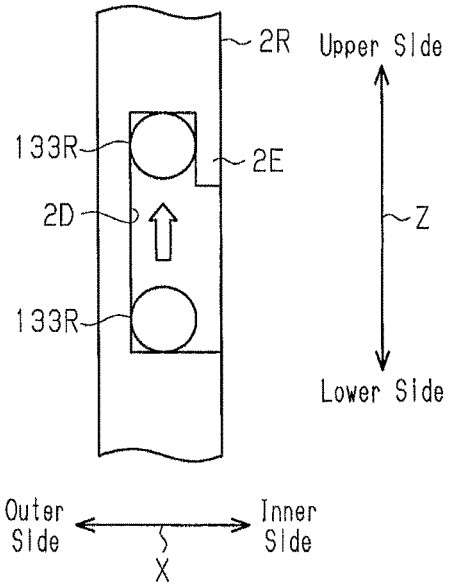
FIG. 19C is a side view showing a portion of a right door of FIG. 19A.

As shown in FIG. 19C, when the movable bracket 61 is in the unlocked position, the pin 133R is located in a lower end portion of the receptacle 2D of the door 2R, which functions as a non-restriction position. The lower end portion of the receptacle 2D of the door 2R opens inward in the width direction X, Thus, the pin 133R does not support to limit outward displacement of the door 2R.

As shown in FIG. 19A, when the movable bracket 61 moves from the unlocked position in the locking direction Y2, the wire 131L, moves along the pulley 132R in a direction indicated by the white arrows, and the pin 133L moves downward. Also, the wire 131R moves along the pulley 132R in the direction indicated by the white arrows, and the pin 133R moves upward. Then, as shown in FIG. 19B, when the movable bracket 61 is in the locked position, the pin 133L is located in a lower end portion of the receptacle 2D of the door 2L, which functions as a restriction position, and opposed to a restricted wall 2E formed at a lower side of the receptacle 2D in the width direction X. Also, as shown in FIG. 19C, the pin 133R is located in an upper end portion of the receptacle 2D of the door 2R, which functions as a restriction position, and opposed to a restricted wall 2E formed at an upper side of the receptacle 2D in the width direction X. Thus, when the doors 2L, 2R receive force acting to displace the doors 2L, 2R outward, the pins 133L, 133R come in contact with the restricted walls 2E and limit outward displacement of the doors 2L, 2R.

Figure 20A:
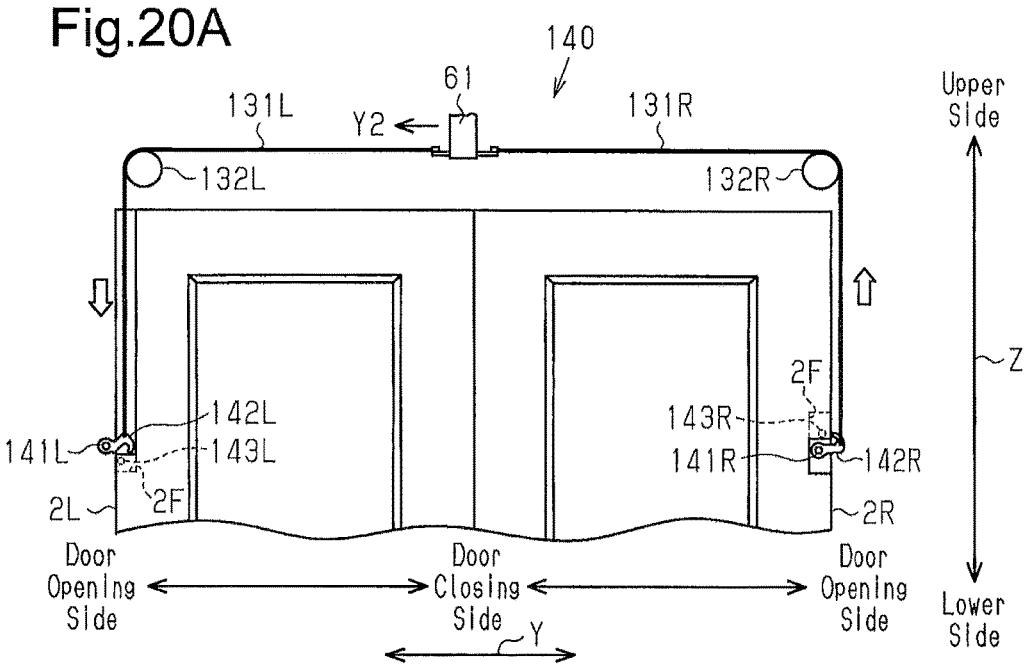
FIG. 20A is a schematic diagram showing a modified example of a door support mechanism.

FIG. 20A shows a door support mechanism 140, which includes support shafts 141L, 141R and engagement claws 142L, 142R instead of the pins 133L, 133R of the door support mechanism 130. The support shafts 141L, 141R are fixed to the vehicle side wall 210 (refer to FIG. 1) and extend inward in the width direction X from the vehicle side wall 210. The engagement claws 142L, 142R are rotatably coupled to the support shafts 141L, 141R. Additionally, the doors 2L, 2R are each provided with a receptacle 2F, which may receive a portion of the corresponding one of the engagement claws 142L, 142R. Two opposite sides of each receptacle 2F in the width direction X are closed. A pin 143L, which extends in the width direction X, is coupled to the door 2L in a lower part of the receptacle 2F of the door 2L. Also, a pin 143R, which extends in the width direction X, is coupled to the door 2R in an upper part of the receptacle 2F of the door 2R.

Figure 20B:
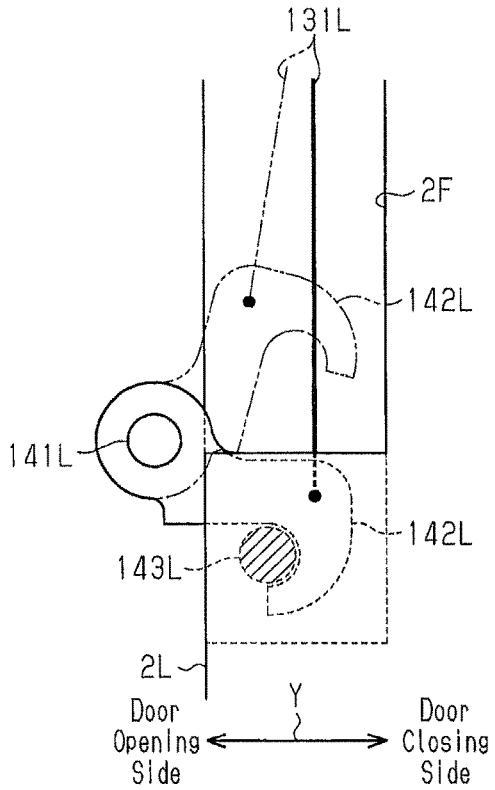
FIG. 20B is a schematic front view showing a portion of a left door of FIG. 20A.
Figure 20C:
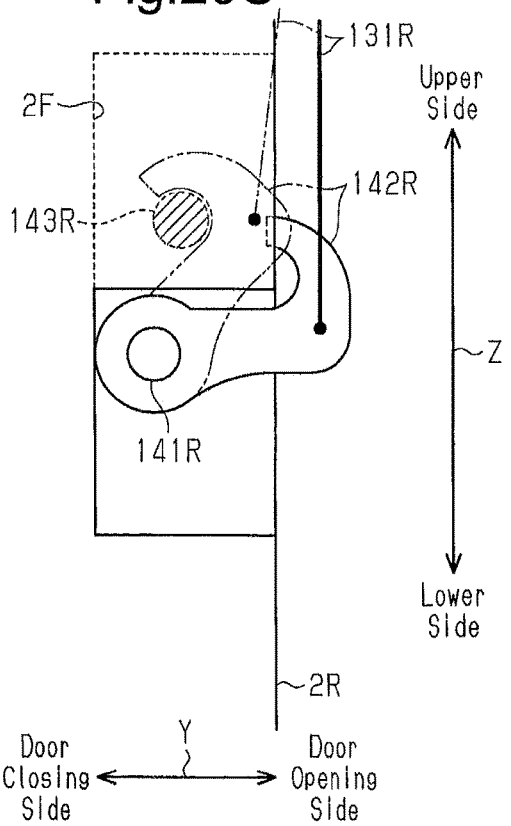
FIG. 20C is a schematic front view showing a portion of a right door of FIG. 20A.

As shown in FIG. 20A, when the movable bracket 61 moves from the unlocked position in the locking direction Y2, the wire 131L moves along the pulley 132L in a direction indicated by the white arrows, and a distal end of the engagement claw 142L moves downward as rotating about the support shaft 141L. In contrast, a distal end of the engagement claw 142R moves upward as rotating about the support 141R. Then, as shown in FIG. 20B, when the movable bracket 61 is located in the locked position, the engagement claw 142L is located in the lower end portion of the receptacle 2F of the door 2L, which functions as a restriction position, and engaged with the pin 143L. Also, as shown in FIG. 20C the engagement claw 142R is located in the upper end portion of the receptacle 2F of the door 2R, which functions as a restriction position, and engaged with the pin 143R. Thus, when the doors 2L, 2R receive force acting to displace the doors 2L, 2R outward, the pins 133L, 133R come in contact with the restricted walls 2E and support the doors 2L, 2R.

Figure 21:
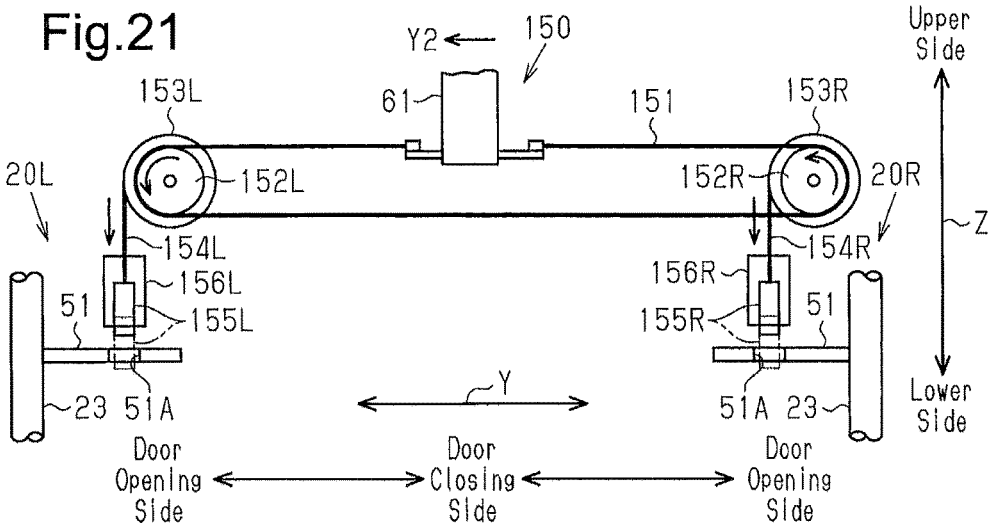
FIG. 21 is a schematic front view showing a portion of a modified example of a door support mechanism and a swing arm mechanism.

FIG. 21 shows a door support mechanism 150, which includes a first wire 151, which is coupled to the movable bracket 61, and two first pulleys 152L, 152R, which are separated in the front-rear direction Y and support the first wire 151. The first wire 151 is wound around the first pulleys 152L, 152R to be annular. The first pulleys 152L, 152R are coupled to second pulleys 153L, 153R, which are located at an outer side of the first pulleys 152L, 152R and rotate integrally with the first pulleys 152L, 152R. Second wires 154L, 154R are wound around the second pulleys 153L, 153R, respectively. Pins 155L, 155R are coupled to distal ends of the second wires 154L, 154R, respectively. The pins 155L, 155R are located above the upper swing arms 51 of the swing arm mechanisms 20L, 20R and extend in the height direction Z. The upper swing arms 51 are each provided with a through hole 51A, which may receive the corresponding one of the pins 155L, 155R. The pins 155L, 155R are located above the upper swing arms 51, which function as a non-restriction position. In particular, when the doors 2L, 2R are completely closed, the pins 155L, 155R are arranged to overlap the through holes 51A of the upper swing arms 51 in the height direction Z. The pins 155L, 155R are partially inserted into cylinders 156L, 156R, respectively, which are fixed to the vehicle side wall 210 (refer to FIG. 1).

When the movable bracket 61 moves from the unlocked position in the locking direction Y2, movement of the first wire 151 rotates the first pulleys 152L, 152R and the second pulleys 153L, 153R. Consequently, when the second wires 154L, 154R move downward, the pins 155L, 155R move downward. Then, when the movable bracket 61 is located in the locked position, the pins 155L, 155R are inserted into the through holes 51A of the upper swing arms 51, that is, located at the restriction position. Thus, even when the doors 2L, 2R receive force acting to displace the doors 2L, 2R outward, the pins 155L, 155R, which are supported by the cylinders 156L, 156R, restrict rotation of the upper swing arms 51. This limits outward displacement of the doors 2L, 2R.

Figure 22:
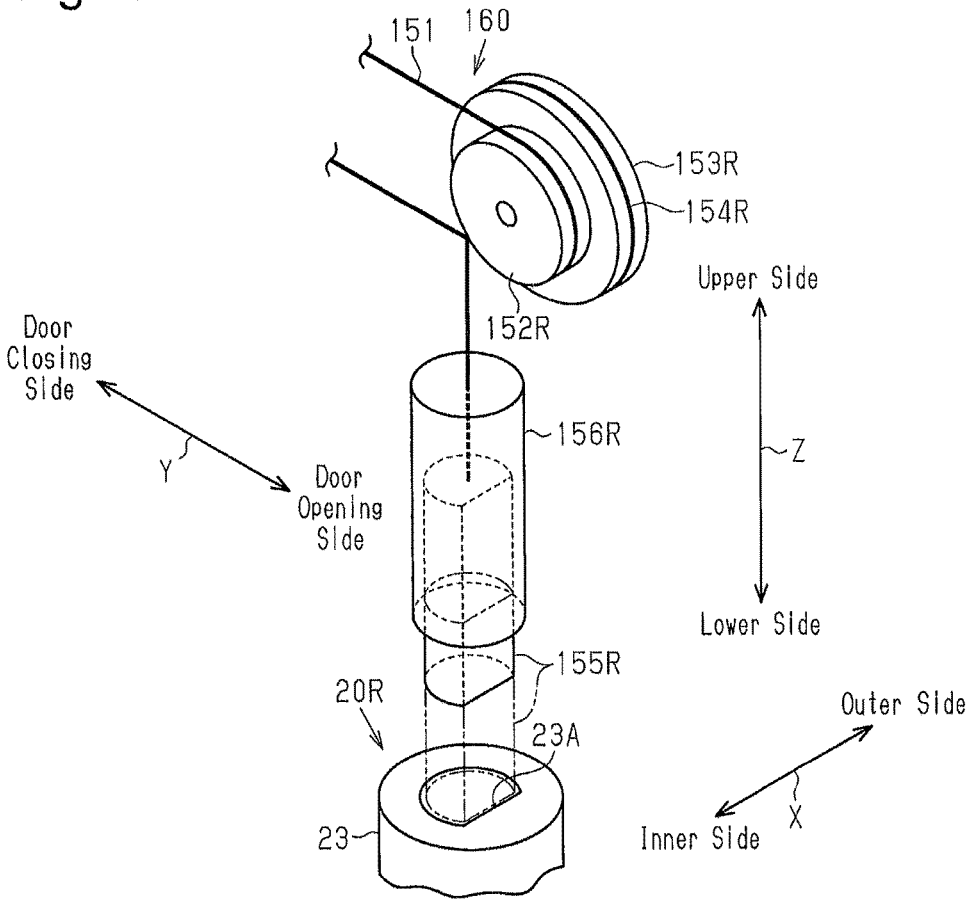
FIG. 22 is a schematic front view showing a portion of a modified example of a door support mechanism and a swing arm mechanism.

FIG. 22 shows a door support mechanism 160, which is configured to restrict rotation of the pillar 23 of the swing arm mechanism 20R, while the door support mechanism 150 restricts rotation of the upper swing arms 51. The upper end surface of the pillar 23 is provided with a fitting hole 23A, which is recessed downward. The fitting hole 23A is D-shaped. Additionally, the pin 155R is located above the upper end surface of the pillar 23 and D-shaped. Although not shown in FIG. 22, the pin 155L and the pillar 23 of the swing arm mechanism 20L have the same shape as the pin 155R and the pillar 23 of the swing arm mechanism 20R.

When the movable bracket 61 (refer to FIG. 21) is located in the locked position, the pin 155R is fitted into the fitting hole 23A. This restricts rotation of the pillar 23 and limits outward displacement of the door 2R.

Figure 23:
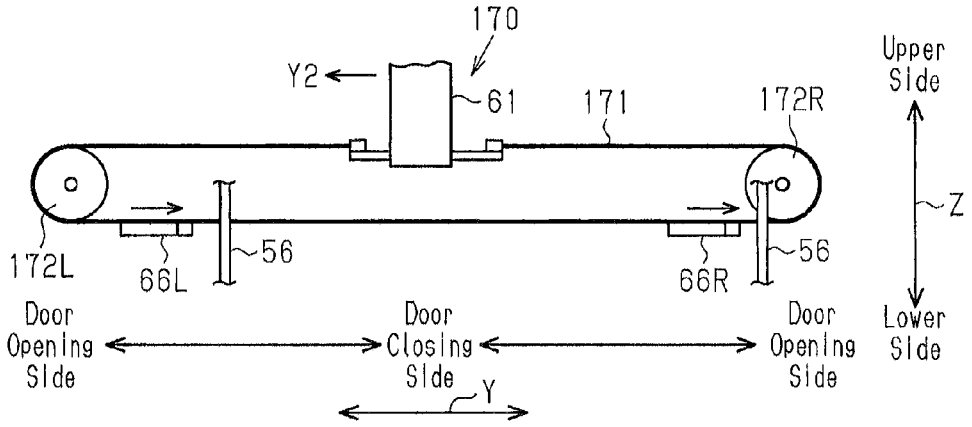
FIG. 23 is a schematic front view showing a portion of a modified example of a door support mechanism.

FIG. 23 shows a door support mechanism 170 including a wire 171, which is coupled to the movable bracket 61, and two pulleys 172L, 172R, which are separated in the front-rear direction Y and support the wire 171. The wire 171 is wound around the pulleys 172L, 172R to be annular. The restriction members 66L, 66R are coupled to a lower portion of the annular wire 171. The restriction members 66L, 66R move integrally with the wire 171. The position of the restriction members 66L, 66R relative to the restricted rods 56 in the front-rear direction Y is opposite to the position of the restriction members 66L, 66R of the above embodiment relative to the restricted rods 56 in the front-rear direction Y.

The door support mechanisms 100, 110, which are shown in FIGS. 17 and 18, may be located in any position. For example, the door support mechanisms 100, 110 are located on the lower end portions of the doors 2L, 2R or the door opening-side side walls of the doors 2L, 2R.

The door support mechanisms 130, 140, which are shown in FIGS. 19 and 20, may be modified as follows. In FIG. 19, the receptacles 2D of the doors 2L, 2R and the pins 133L, 133R of the door support mechanism 130 are located in the lower end portions of the doors 2L, 2R. In FIG. 20, the receptacles 2F of the doors 2L, 2R and the pins 143L, 143R of the door support mechanism 140 are located in the lower end portions of the doors 2L, 2R.

The doors 2L, 2R shown in FIGS. 17 to 20 may be modified as follows. In FIG. 17, the slits 2A are omitted from the doors 2L, 2R, and the restricted walls 2B extend from the door opening-side side walls of the doors 2L, 2R toward the corresponding door opening sides. In FIG. 18, the receptacles 2C are omitted from the doors 2L, 2R, and restricted walls extend from the door opening-side side walls of the doors 2L, 2R toward the corresponding door opening sides. In this case, when located in the restricted position, the cams 111 are opposed to the restricted walls in the width direction X. In FIGS. 19 and 20, the receptacles 2C, 2D are omitted from the doors 2L, 2R, and restricted walls extend from the door opening-side side walls of the doors 2L, 2R toward the corresponding door opening sides.

The modified examples of FIGS. 17 to 20 do not include the swing arm mechanisms 20L, 20R.

The door support mechanism 150, which is shown in FIG. 21, may be modified as follows. The door support mechanism 150 restricts rotation of the lower swing arms 25 with the pins 155L, 155R instead of restricting rotation of the upper swing arms 51. In this case, the second wires 154L, 154R extend to lower portions of the pillars 23, and the pins 155L, 155R are located at the lower portions of the pillars 23 above the lower swing arms 25.

The number of the rod length adjustment mechanisms 65C may be changed. Alternatively, the rod length adjustment mechanism 65C may be omitted.

The rod length adjustment mechanism 65C may be configured to change the length of a versatile extendable rod assembly. Such an adjustment mechanism may include, for example, a screw that is fastened from the outside of a tubular second rod when a first rod is inserted into the second rod. The screw fastens the first rod and the second rod when the relative position of the first rod and the second rod is adjusted in the longitudinal direction. For example, a fastening nut that fixes an extendable multitubular rod assembly at the adjusted length may be used. The arm length adjustment mechanism 53 of the auxiliary arm 52 may be changed in the same manner as the rod length adjustment mechanism 65C.

The door support mechanism 60 may include a single coupling rod instead of the coupling rods 65L, 65R. The restriction members 66L, 66R are coupled to the single coupling rod.

The door support mechanism 60 may exclude at least one of the roller 63, the connection member 62C, and the guide member 62. The door support mechanism 60 excludes the roller 63, the block 15E is omitted from the second coupling plate 15B. When the door support mechanism 60 excludes the connection member 62C, the roller 63 is rotatably coupled to the upper coupling portion 61A of the movable bracket 61.

The movable bracket 61 of the door support mechanism 60 may be directly connected to the carrier. More specifically, a modified example of the door support mechanism 60 does not include the lock slider 18. In this case, the movable bracket 61 includes a projection functioning as the lock slider 18.

The door support mechanism 60 may have any structure in which the movable bracket 61 and the restriction members 66L, 66R are coupled. For example, the movable bracket 61 and the restriction members 66L, 66R may be coupled by a gear train or a wire instead of the coupling rods 65L, 65R.

The restricted rod 56 of each coupling mechanism 50 does not have to be coupled to the guide arm 21.

Each coupling mechanism 50 does not have to include the rod wheel 57. In this case, when the restricted rods 56 contact the restriction members 66L, 66R, rotation of the upper swing arms 51 is restricted.

Each coupling mechanism 50 does not have to include the auxiliary arm 52. In this case, the restricted rod 56 is coupled to the upper swing arm 51.

The auxiliary arm 52 of each coupling mechanism 50 may be coupled to the upper swing arm 51 in a non-rotatable manner.

The restricted rod 56 of each coupling mechanism 50 may be coupled to the auxiliary arm 52 and rotatable relative to the auxiliary arm 52 about the rotational axis extending in the height direction Z. In this case, the rod wheel 57 may be omitted.

The auxiliary arm 52 of each coupling mechanism 50 may be coupled to the guide arm 21. In this case, the restricted rod 56 is coupled to the auxiliary arm 52 and the upper swing arm 51.

The number of the arm length adjustment mechanisms 53 may be changed. Alternatively, the arm length adjustment mechanism 53 may be omitted. In this case, in the auxiliary arm 52, the basal portion 54 and the distal portion 55 are coupled to each other.

The members that restrict rotation of the upper swing arms 51 when contacting the restriction members 66L, 66R do not have to be rod-shaped such as the restricted rod 56 and may be block-shaped or spherical. The shape of the members that restrict rotation of the upper swing arms 51 may be other than rod-like as long as the rotation of the upper swing arms 51 is restricted when contacting the restriction members 66L, 66R.

The rod wheels 57 do not have to contact the flat surfaces 66A when the restriction members 66L, 66R move in the locking direction Y2.

The guide member may be fixed to the base 11 and include a rail, which extends in the front-rear direction Y, and a wheel, which rolls in the rail. The wheel may be coupled to the upper coupling portion 61A of the movable bracket 61 and rotatable relative to the upper coupling portion 61A.

The guide member may be fixed to the base 11 and include a tubular bushing, which extends in the front-rear direction Y, and a pin, which is inserted into the bushing and movable relative to the bushing in the front-rear direction Y. The pin includes a front end and a rear end, which respectively project frontward and rearward from the bushing. The two opposite ends of the pin are coupled to the upper coupling portion 61A of the movable bracket 61.

The guide member may guide the coupling rods 65L, 65R or the restriction members 66L, 66R in the front-rear direction Y instead of guiding the movable bracket 61.

Figure 24:
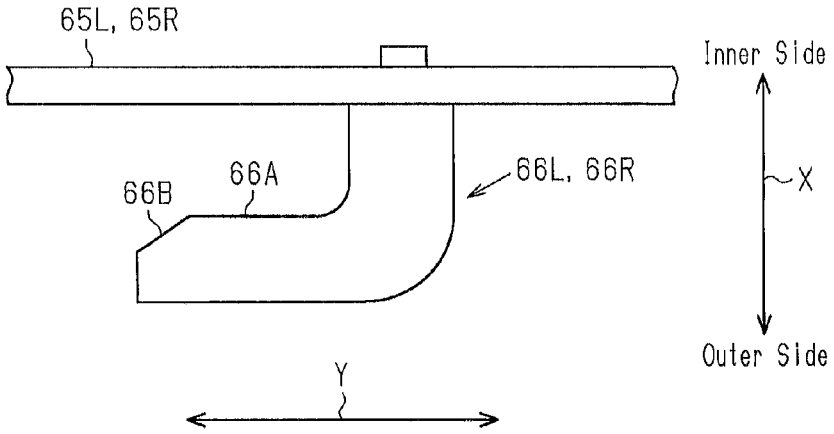
FIG. 24 is a schematic bottom view showing a modified example of a restriction member and a link rod.

As shown in FIG. 24, the restriction members 66L, 66R may each be L-shaped. The restriction members 66L, 66R each include the flat surface 66A and the inclined surface 66B in the same manner as the restriction members 66L, 66R of the above embodiment.

The restriction members 66L, 66R may each include a tetragonal piece. The restriction members 66L, 66R restrict rotation of the upper swing arms 51 of the swing arm mechanisms 20L, 20R when contacting the restricted rods 56 in the front-rear direction Y.

In the structure in which the restriction members 66L, 66R restrict rotation of the swing arm mechanisms 20L, 20R, the restriction members 66L, 66R may each be projected, and the upper swing arms 51 of the swing arm mechanisms 20L, 20R may each include a recessed movable portion. The restriction members 66L, 66R may be fitted into the recessed movable portions. For example, when located at the restriction position, the above restriction members 66L, 66R, each of which includes the tetragonal piece, are fitted to the recessed portions formed in the upper swing arms 51 of the swing arm mechanisms 20L, 20R.

In a modified example, at least one of the flat surface 66A and the inclined surface 66B is omitted from each of the restriction members 66L, 66R.

The inclined surface 66B of each of the restriction members 66L, 66R may have any inclination angle relative to the front-rear direction Y and any size in the front-rear direction. More specifically, in this modified example, the inclination angle of the inclined surface 66B of this modified example may be larger or smaller than the inclination angle of the inclined surface 66B of the above embodiment relative to the front-rear direction Y. The size, in the front-rear direction Y, of the inclined surface 66B of this modified example may be larger or smaller than that of the inclined surface 66B of the above embodiment.

The flat surface 66A of each of the restriction members 66L, 66R may have any size in the front-rear direction Y. More specifically, the size, in the front-rear direction Y, of the flat surface 66A may be larger or smaller than that of the flat surface 66A of the above embodiment.

The restriction members 66L, 66R may each include an inclined portion or a curved portion instead of the flat surface 66A.

The restriction members 66L, 66R may restrict rotation of the swing arm mechanisms 20L, 20R by directly contacting at least one of the guide arms 21, the upper swing arms 51, the auxiliary arms 52, the pillars 23, and the lower swing arms 25. The restriction members 66L, 66R only need to restrict movement of the swing arm mechanisms 20L, 20R when contacting movable portions of the swing arm mechanisms 20L, 20R.

The number of the support members 67 may be changed to three or less or five or more.

The support members 67 may be directly fixed to the vehicle side wall 210 or fixed to a member that is other than the base 11 and fixed to the vehicle side wall 210.

The support members 67 may be arranged to support each coupling rod 65L (65R) at only one of the front and rear of the restriction member 66L (66R).

Figure 25:
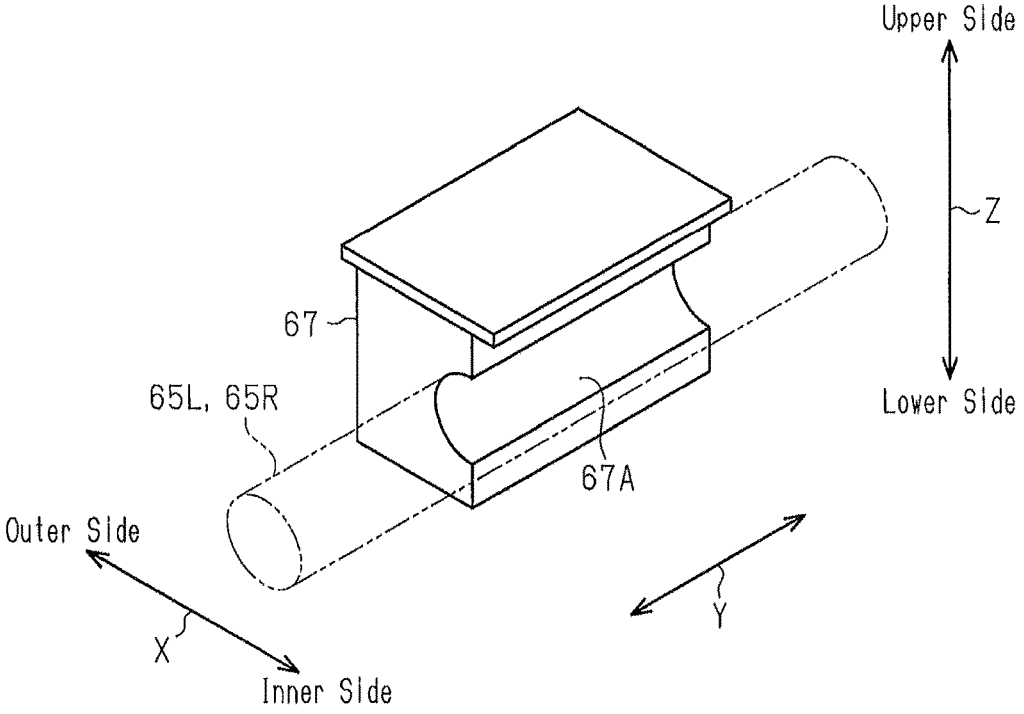
FIG. 25 is a schematic perspective view showing a modified example of a support member.

As shown in FIG. 25, the support member 67 may include a support portion 67A, which has a curved recessed surface and supports one of the coupling rods 65L, 65R from the outer side. Alternatively, the support member 67 may include a flat surface, which extends in the front-rear direction Y and the height direction Z and supports one of the coupling rods 65L, 65R from the outer side. The support member 67 may be other than tubular as long as the support member 67 is configured to support the coupling rods 65L, 65R from the outer side. Additionally, the support members 67 may differ in shape from one another.

The support portion 67A of the support member 67 of FIG. 25 may open upward or downward. The direction in which the support portion 67A opens is not limited as long as one of the coupling rods 65L, 65R can be supported from the outer side.

The swing arm mechanisms may guide movement of the doors 2L, 2R using a gear train or a link instead of guiding the guide arms 21 and the lower swing arms 25.

The upper swing arms 51 and the lower swing arms 25 may be coupled by wires instead of the pillars 23.

The swing arm mechanisms do not have to include the lower swing arms 25. In this case, the lower sliding rails 30L, 30R, which are coupled to the doors 2L, 2R, are omitted.

The swing arm mechanisms do not have to include the upper swing arms 51. In this case, the door support mechanism 60 is configured to restrict rotation of the lower swing arms 25 or the pillars 23.

The swing arm mechanisms may have a height that is approximately one-half of that of the doors 2L, 2R in the height direction Z. In this case, the upper swing arms 51 are located in positions that correspond to middle portions of the doors 2L, 2R in the height direction Z. The pillars 23 have a length from the lower portions of the doors 2L, 2R to the middle portions of the doors 2L, 2R in the height direction Z.

The guide arm 21 of each swing arm mechanism may be coupled to the upper end portion of the pillar 23.

The number of the guide arms 21 may be changed to five or more or three or less.

At least one of the pressed portions 34, which are coupled to the lower sliding rails 30L, 30R, may be omitted. In this case, the roller 27 is omitted from the lower swing arm 25 that corresponds to the pressed portion 34.

Figure 26:
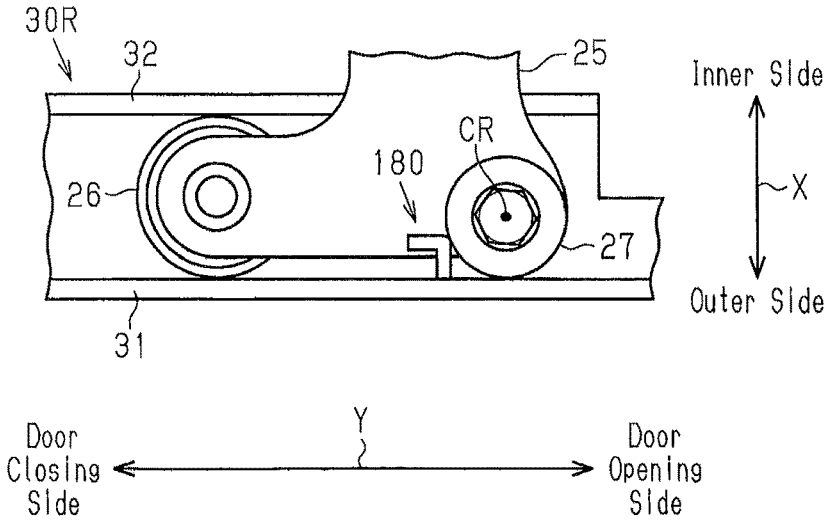
FIG. 26 is a bottom view showing a modified example of a lower swing arm including a distal portion and its surrounding.

As shown in FIG. 26, a pressed portion 180 of the lower sliding rail 30R may extend in the width direction X. The inner end surface of the pressed portion 180 in the width direction X may be located at an outer side of the center CR of the roller 27 of the lower swing arm 25. The pressed portion 180 of the lower sliding rail 30L is configured in the same manner.

The pressed portion 180 of FIG. 26 may include an inclined surface that is inclined inward in the width direction X as extending from the inner end in the width direction X toward the door closing side.

The pressed portion 180 does not have to be coupled to at least one of the lower sliding rails 30L, 30R.

The lower sliding rails 30L, 30R do not have to include the outer walls 31.

The roller 27 of each lower swing arm 25 may be changed to a projection that can contact the pressed portion 34. The projection is configured to press the pressed portion 34 toward the door closing side when the doors 2L, 2R are completely closed.

The rollers 26 may be omitted from the lower swing arms 25, and the distal ends of the lower swing arms 25 may contact the lower sliding rails 30L, 30R.

Figure 27:
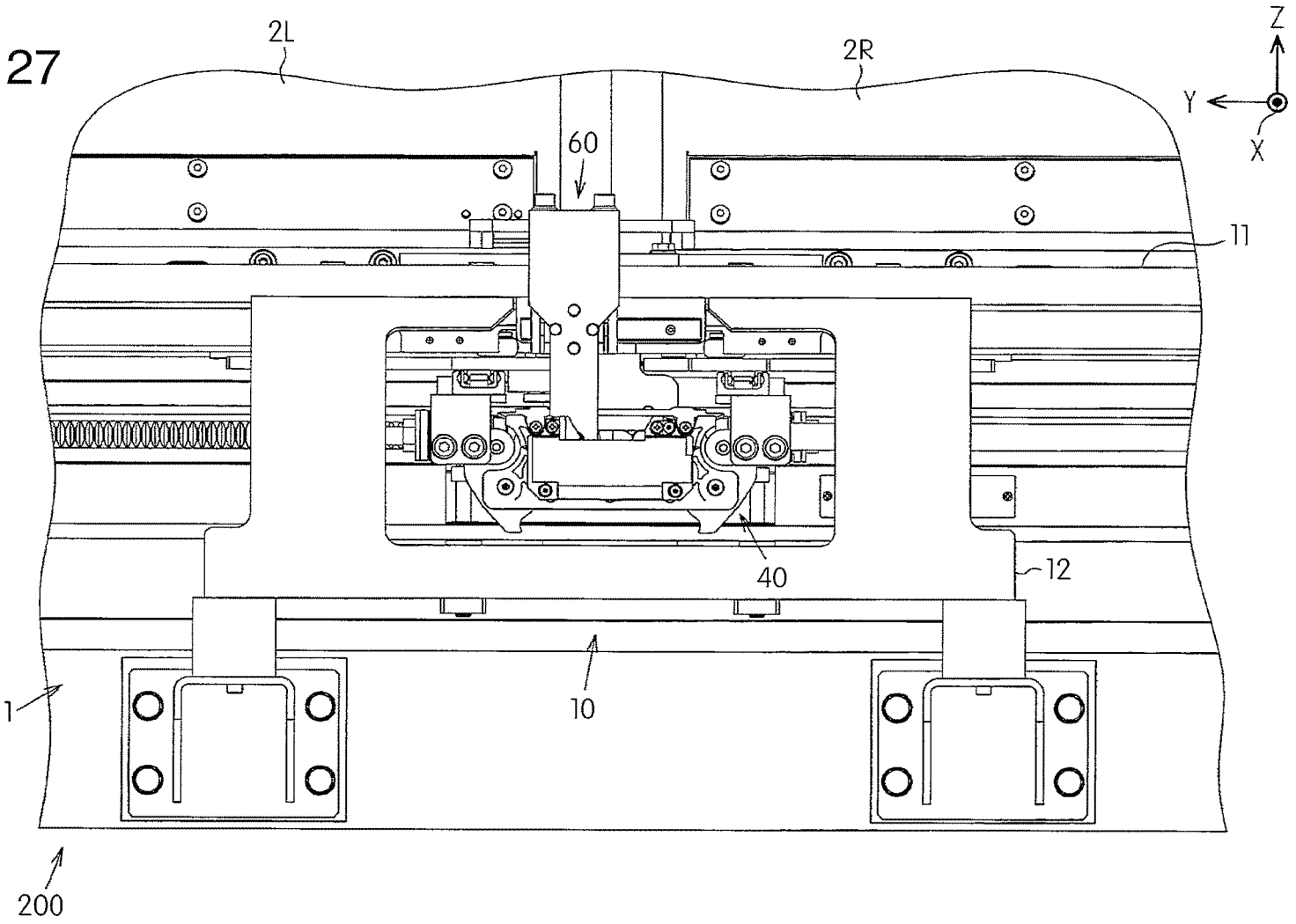
FIG. 27 is an enlarged view showing a plug door opening-closing apparatus of a modified example.

At least one of the lock mechanism 40 and the drive mechanism 13 may be located on the lower end portions of the doors 2L, 2R as shown in FIG. 27.

The plug door opening-closing apparatus 10 may include the drive mechanism 13, which moves the doors 2L, 2R, and a drive mechanism that differs from the drive mechanism 13 and is dedicated to locking. The locking dedicated drive mechanism drives the lock mechanism 40 to lock and unlock the doors 2L, 2R.

The drive mechanism 13 is not limited to the illustrated drawings and embodiments. For example, the drive mechanism 13 may include a roll-type transmission device, such as a pulley-belt transmission device and a chain transmission device, instead of the rack gears 14L, 14R. The belt of the roll-type transmission device is coupled to the door hangers 15L, 15R. Movement of the belt moves the door hangers 15L, 15R in the front-rear direction Y. Alternatively, the drive mechanism 13 may include two screws and a plurality of motors, which are coupled to the screws, instead of the rack gears 14L, 14R. When the motors rotate the screws, the door hangers 15L, 15R, which are coupled to the screws, move in the front-rear direction Y. Alternatively, the drive mechanism 13 may include the above screws, nuts, which are movably coupled to the screws, motors, which rotate the nuts, and the door hangers 15L, 15R, which are coupled to the motors.

The plug door device 1 may include one single sliding door. In this case, the plug door device 1 includes a single swing arm mechanism, and the door support mechanism 60 includes a single coupling rod and a single restriction member.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above detailed description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the detailed description, with each claim standing on its own as a separate embodiment. The scope of the invention should be determined with reference to the appended claims, along with the full scope of equivalents to which such claims are entitled.

The invention claimed is:

1. A plug door opening-closing apparatus comprising:

a lock mechanism arranged on one of an upper portion and a lower portion of at least one door of a vehicle, wherein the lock mechanism is configured to contact and constrain a door hanger fixed to the door when the door is in a completely closed position so that the door does not open;

a drive mechanism coupled to the lock mechanism, wherein the drive mechanism drives the lock mechanism to switch the door from an unlocked state to a locked state; and a door support mechanism including a movable member mechanically coupled to the lock mechanism and movable in a vehicle front-rear direction, a first movable mechanism separated from the movable member in a height direction of the vehicle, movably connected to the movable member, and supporting the door, and a second movable mechanism connecting the movable member and the first movable mechanism, the door support mechanism being configured such that, when the door is in the completely closed position and in the locked state, at least the first movable mechanism of the door support mechanism hinders outward displacement, in a vehicle width direction, of the other one of the upper portion and the lower portion of the door, wherein the second movable mechanism includes at least one swing arm mechanism that guides movement of the door in the vehicle width direction, wherein the door support mechanism includes a restriction member that limits movement of a movable portion of the swing arm mechanism to restrict movement of the swing arm mechanism, and wherein, when the door is in the completely closed position and the drive mechanism drives the lock mechanism to switch the door from the unlocked state to the locked state, the restriction member is moved from (a) a non-restriction position, where the restriction member does not restrict the movement of the swing arm mechanism to (b) a restriction position, where the restriction member restricts the movement of the swing arm mechanism.

2. The plug door opening-closing apparatus according to claim 1, wherein the restriction member contacts the movable portion of the swing arm mechanism when the restriction member is in the restriction position.

3. The plug door opening-closing apparatus according to claim 1, wherein the drive mechanism is arranged on the upper portion of the door, and wherein the movable portion of the swing arm mechanism defines an upper portion of the swing arm mechanism.

4. The plug door opening-closing apparatus according to claim 1, wherein the movable member is a movable bracket, wherein the movable bracket moves in the vehicle front-rear direction; and wherein the door support mechanism further includes a coupling rod that extends in the vehicle front-rear direction and that couples the movable bracket and the restriction member.

5. The plug door opening-closing apparatus according to claim 4, wherein the coupling rod includes a length adjustment mechanism.

6. The plug door opening-closing apparatus according to claim 4, wherein the door support mechanism further includes at least one support member fixed to the vehicle, and wherein the support member is adapted to support the coupling rod.

7. The plug door opening-closing apparatus according to claim 6, wherein the at least one support member comprises a plurality of support members that support the coupling rod, and wherein the restriction member is located between a pair of adjacent said support members.

8. The plug door opening-closing apparatus according to claim 4, wherein the door support mechanism further includes a guide member that guides the movement of the movable bracket in the vehicle front-rear direction.

9. The plug door opening-closing apparatus according to claim 4, wherein the at least one door comprises two doors, wherein the at least one swing arm mechanism comprises two swing arm mechanisms, which respectively correspond to the two doors, and wherein the restriction member comprises two restriction members that respectively correspond to the two swing arm mechanisms and the coupling rod comprises two coupling rods that respectively correspond to the two swing arm mechanisms.

10. The plug door opening-closing apparatus according to claim 1, wherein the swing arm mechanism includes an upper swing arm configured to be rotated about a rotational axis, which extends in the height direction of the vehicle, when the upper swing arm receives a force, and wherein the movable portion of the swing arm mechanism includes the upper swing arm.

11. The plug door opening-closing apparatus according to claim 10, wherein the swing arm mechanism further includes a restricted rod coupled to the upper swing arm, wherein the restricted rod extends in the height direction of the vehicle.

12. The plug door opening-closing apparatus according to claim 11, further comprising: a guide arm that moves the door in the vehicle width direction when rotated, wherein the restricted rod is coupled to the guide arm.

13. The plug door opening-closing apparatus according to claim 12, further comprising: an auxiliary arm coupled to the upper swing arm, wherein the auxiliary arm adjusts a position of the upper swing arm relative to the guide arm, and wherein the restricted rod, which is coupled to the auxiliary arm, couples the restricted rod to the upper swing arm.

14. The plug door opening-closing apparatus according to claim 13, wherein the auxiliary arm includes a length adjustment mechanism.

15. The plug door opening-closing apparatus according to claim 11, wherein the swing arm mechanism further includes a rod wheel rotatably coupled to the restricted rod.

16. The plug door opening-closing apparatus according to claim 10, wherein the swing arm mechanism further includes a lower swing arm that supports the lower portion of the door, and wherein the second movable mechanism comprises a pillar that couples the upper swing arm and the lower swing arm.

17. The plug door opening-closing apparatus according to claim 16, wherein the first movable mechanism comprises a pressed portion coupled to the door, wherein, when the door is in the completely closed position, the pressed portion comes into contact with a roller on the lower swing arm.

18. The plug door opening-closing apparatus according to claim 17, wherein the pressed portion includes a contact surface that contacts the roller on the lower swing arm when the door is in the completely closed position, and the contact surface is inclined relative to the vehicle front-rear direction, wherein the first movable mechanism comprises a second roller coupled to the lower swing arm, wherein the plug door opening-closing apparatus further comprising a lower sliding rail coupled to the lower portion of the door and extending in the vehicle front-rear direction, and wherein the lower swing arm supports the lower sliding rail via the second roller that contacts with the lower sliding rail.

19. The plug door opening-closing apparatus according to claim 1, wherein the restriction member includes a flat surface that extends in the vehicle front-rear direction, and wherein the flat surface is configured to contact the movable portion of the swing arm mechanism.

20. The plug door opening-closing apparatus according to claim 19, wherein the restriction member includes an inclined surface, and wherein the inclined surface is continuous with the flat surface and inclined outward in the vehicle width direction from the flat surface.

21. The plug door opening-closing apparatus according to claim 1, wherein the drive mechanism also functions as a drive that opens and closes the door.

22. A plug door device comprising:

at least one door of a vehicle; and a plug door opening-closing apparatus that opens and closes the at least one door, the plug door opening-closing apparatus comprising:

a lock mechanism arranged on one of an upper portion and a lower portion of the at least one door, wherein the lock mechanism is configured to contact and constrain a door hanger fixed to the door when the door is in a completely closed position so that the door does not open;

a drive mechanism coupled to the lock mechanism, wherein the drive mechanism drives the lock mechanism to switch the door from an unlocked state to a locked state; and a door support mechanism including a movable member mechanically coupled to the lock mechanism and movable in a vehicle front-rear direction, a first movable mechanism separated from the movable member in a height direction of the vehicle, movably connected to the movable member, and supporting the door, and a second movable mechanism connecting the movable member and the first movable mechanism, the door support mechanism being configured such that, when the door is in the completely closed position and in the locked state, at least the first movable mechanism of the door support mechanism hinders outward displacement, in a vehicle width direction, of the other one of the upper portion and the lower portion of the door, wherein the second movable mechanism includes at least one swing arm mechanism that guides movement of the door in the vehicle width direction, wherein the door support mechanism includes a restriction member that limits movement of a movable portion of the swing arm mechanism to restrict movement of the swing arm mechanism, and wherein, when the door is in the completely closed position and the drive mechanism drives the lock mechanism to switch the door from the unlocked state to the locked state, the restriction member is moved from (a) a non-restriction position, where the restriction member does not restrict the movement of the swing arm mechanism to (b) a restriction position, where the restriction member restricts the movement of the swing arm mechanism.

* * * * *